US010821324B2

(12) United States Patent
Paganelli et al.

(10) Patent No.: US 10,821,324 B2
(45) Date of Patent: Nov. 3, 2020

(54) ADAPTIVE CONTROL METHOD OF A TREADMILL AND TREADMILL IMPLEMENTING SAID METHOD

(71) Applicant: TECHNOGYM S.p.A., Forli'-Cesena (IT)

(72) Inventors: Paolo Paganelli, Forli'-Cesena (IT); Alessandro Del Monaco, Forli'-Cesena (IT); Fabio Ronchi, Forli'-Cesena (IT)

(73) Assignee: TECHNOGYM S.p.A., Forli'-Cesena (IT)

( * ) Notice: Subject to any disclaimer, the term of this patent is extended or adjusted under 35 U.S.C. 154(b) by 0 days.

(21) Appl. No.: 16/293,276

(22) Filed: Mar. 5, 2019

(65) Prior Publication Data

US 2019/0269972 A1 Sep. 5, 2019

(30) Foreign Application Priority Data

Mar. 5, 2018 (IT) ..... 102018000003278

(51) Int. Cl.
*A63B 24/00* (2006.01)
*A63B 22/02* (2006.01)
(Continued)

(52) U.S. Cl.
CPC ..... *A63B 24/0087* (2013.01); *A63B 21/00* (2013.01); *A63B 22/025* (2015.10);
(Continued)

(58) Field of Classification Search
CPC ..... A63B 24/0087; A63B 22/025; A63B 24/0062; A63B 22/02; A63B 2220/803;
(Continued)

(56) References Cited

U.S. PATENT DOCUMENTS 5,643,142 A * 7/1997 Salerno ..... A63B 22/02 482/1
6,179,754 B1 * 1/2001 Wang ..... A63B 22/0242 482/21

(Continued)

FOREIGN PATENT DOCUMENTS

WO 2009/051298 A1 4/2009

OTHER PUBLICATIONS

Italian Search Report for corresponding Italian Patent Application No. 102018000003278 dated Oct. 26, 2018, 9 pages.

*Primary Examiner* — Nyca T Nguyen
(74) *Attorney, Agent, or Firm* — Merchant & Gould P.C.

(57) ABSTRACT

An adaptive control method for a treadmill includes dividing the physical exercise surface of the treadmill into control zones; detecting, by an electronic control unit, a distance value of a user from a reference point. The electronic control unit compares the detected distance value with the first distance of the first boundary line of a first control zone. If the detected distance value is smaller than the first distance, the method further includes the electronic control unit controlling an increase in feeding speed of the physical exercise surface, and modifying the first distance of a first boundary line of the first control zone from a first value to a second value, along a development direction of the physical exercise surface in a second feeding direction opposite to the first feeding direction. The second value is either greater than or equal to the detected distance value.

25 Claims, 20 Drawing Sheets

(51) Int. Cl.
*A63B 71/06* (2006.01)
*A63B 21/00* (2006.01)

(52) U.S. Cl.
CPC ..... *A63B 24/0062* (2013.01); *A63B 71/0622* (2013.01); *A63B 2024/0093* (2013.01); *A63B 2071/0658* (2013.01); *A63B 2220/12* (2013.01); *A63B 2220/13* (2013.01); *A63B 2220/20* (2013.01); *A63B 2220/803* (2013.01); *A63B 2220/833* (2013.01)

(58) Field of Classification Search
CPC ..... A63B 2220/20; A63B 2220/13; A63B 2024/0093; A63B 2024/009–0096
See application file for complete search history.

(56) References Cited

U.S. PATENT DOCUMENTS 7,094,180 B2 * 8/2006 Huang ..... A63B 22/02 482/51
7,101,319 B1 * 9/2006 Potts ..... A63B 22/0257 482/51
7,153,241 B2 * 12/2006 Wang ..... A63B 22/0242 482/54
7,231,834 B2 * 6/2007 Kurono ..... A61B 5/1038 348/61
7,465,256 B2 * 12/2008 Maenpaa ..... A63B 22/0023 482/54
7,914,420 B2 * 3/2011 Daly ..... A63B 22/0235 119/700
8,480,541 B1 * 7/2013 Brunts ..... A63B 22/0242 482/1
9,084,712 B2 * 7/2015 Roerdink ..... A61H 3/00
9,682,306 B2 * 6/2017 Lin ..... A63B 71/0619
9,974,997 B2 * 5/2018 Cei ..... A63B 22/025
10,220,259 B2 * 3/2019 Brammer ..... A63B 71/0622
2006/0009333 A1 1/2006 Wang
2009/0036272 A1 * 2/2009 Yoo ..... A63B 24/00 482/7
2009/0176629 A1 * 7/2009 Yi ..... A63B 22/025 482/54
2010/0210419 A1 * 8/2010 Park ..... A63B 21/0055 482/7
2013/0123071 A1 * 5/2013 Rhea ..... A63B 24/0087 482/8
2016/0213976 A1 * 7/2016 So ..... A63B 24/0087
2016/0296800 A1 * 10/2016 Devor ..... A63B 24/0062
2017/0136289 A1 * 5/2017 Frank ..... A63B 24/0087
2017/0266534 A1 * 9/2017 Watterson ..... A63B 71/0686
2018/0111023 A1 * 4/2018 Cei ..... A63B 24/0087
2019/0083843 A1 * 3/2019 Del Monaco ..... A63B 22/0235
2019/0240540 A1 * 8/2019 Wei ..... A63B 22/025

* cited by examiner

ADAPTIVE CONTROL METHOD OF A TREADMILL AND TREADMILL IMPLEMENTING SAID METHOD

This application claims benefit of Ser. No. 102018000003278, filed 5 Mar. 2018 in Italy and which application is incorporated herein by reference. To the extent appropriate, a claim of priority is made to the above disclosed application.

FIELD OF THE INVENTION

The present invention relates to the fitness sector and, in particular, to an adaptive control method of a treadmill and to a treadmill implementing such method.

TECHNOLOGICAL BACKGROUND

As known, treadmills are provided with the possibility of varying the speed of rotation of the motor of the treadmill, whereby varying the feeding speed of the belt (training speed) accordingly.

There are treadmills in which the rotation speed of the motor of the treadmill is varied manually by the user by appropriate controls with which a treadmill control unit is provided.

The obvious limits of a manual type control, e.g. due to possible errors by the user, have been overcome by more technologically evolved treadmills, in which the rotation speed of the motor of the treadmill is varied automatically by the treadmill itself, without needing any manual intervention by the user.

In particular, in this second case, the treadmill is provided, for example, with a distance sensor which is configured to detect and communicate the user's position with respect to such distance sensor to a control unit of the treadmill. The control unit is, in turn, configured to compare the position detected by the distance sensor with a reference position and consequently to vary the rotation speed of the treadmill motor as a function of the outcome of such comparison.

Such control method of the treadmill, albeit automatic, is not free from faults.

Indeed, if the user wishes to increase or decrease the training speed, the control unit cannot ensure the actual reaching of the rotation speed of the motor of the treadmill desired by the user on the basis of the user's position with respect to the distance sensor.

This may not ensure high-performance training or safe and reliable training, which avoids, for example, the risk of excessive tiredness or even falling of the user, whereby failing to satisfy in the best manner the need strongly felt nowadays to avail of a treadmill the timely control of which allows the user to perform high-performance and comfortable trainings with an adequate safety level.

SUMMARY

It is the purpose of the present invention to devise and provide an adaptive control method of a treadmill which allows avoiding at least in part the aforesaid drawbacks with reference to the prior art, which in particular can ensure the timely and actual reaching of a rotation speed value of the electric motor of the treadmill (correlated with the training speed) corresponding to that required and expected by the user, whereby allowing the user to train as reliably and safely as possible.

A further object of the present invention is a treadmill implementing such a method and a respective program product.

BRIEF DESCRIPTION OF THE FIGURES

Further features and advantages of the adaptive control method of a treadmill, of the treadmill and of the respective program product according to the present invention will be apparent from the following description indicatively provided by way of non-limiting example with reference to the accompanying figures, in which:

FIGS. 8*b*' and 8*c*' diagrammatically show a portion of a graphic interface of the treadmill during subsequent operating mode of the adaptive control method of a treadmill according to an embodiment of the present invention;

DETAILED DESCRIPTION

Figure 1:
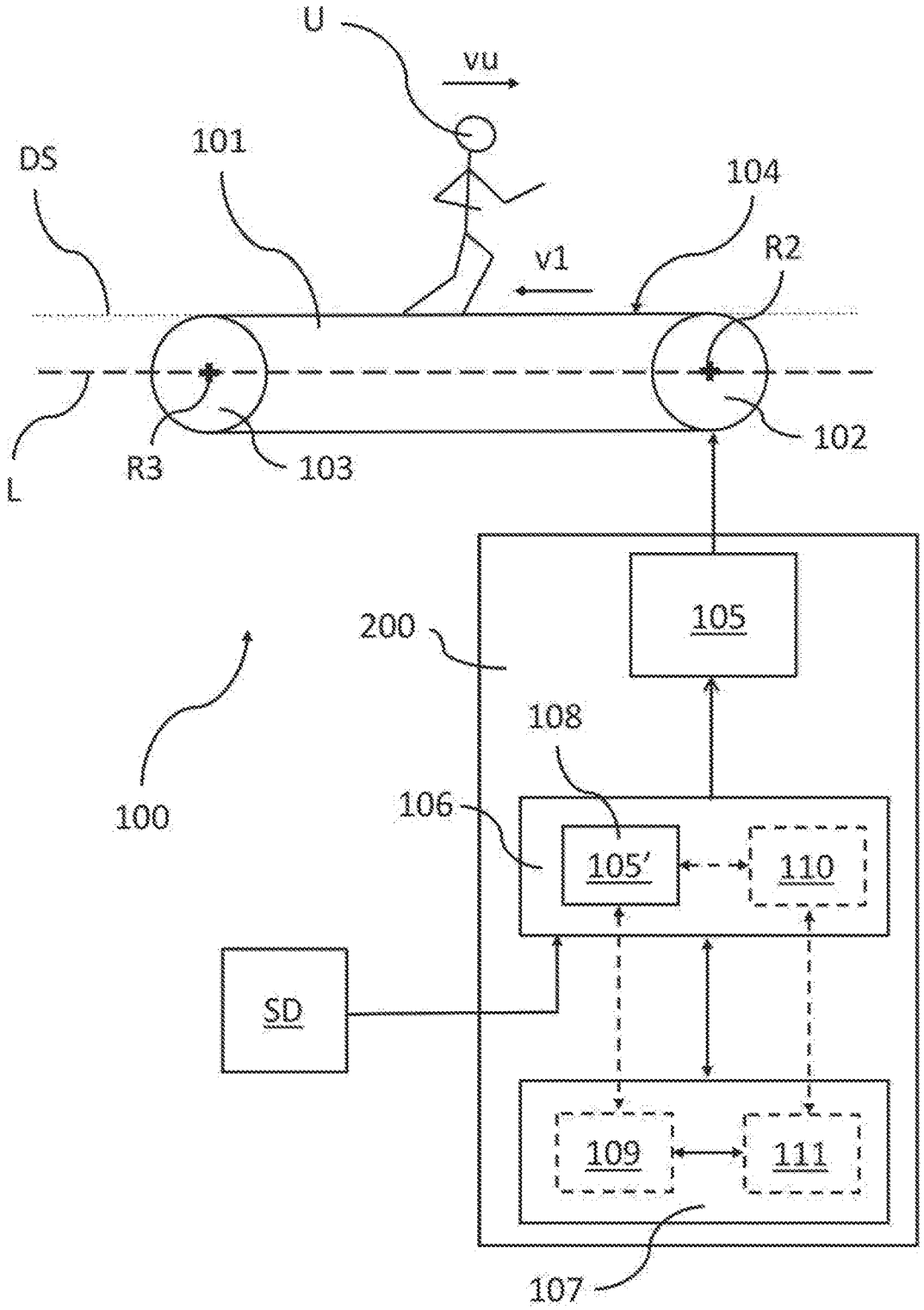
FIG. 1 shows, by a block chart, a treadmill according to an embodiment of the present invention.

With general reference to the aforesaid figures, a treadmill will now be described, indicated as a whole by reference numeral 100, according to an embodiment of the present invention.

It is worth noting that equivalent or similar elements are indicated by the same numerical and/or alphanumerical reference in the aforesaid figures.

It is worth noting that FIG. 1 shows an embodiment of the treadmill 100 and of some components simply by a block chart in order to highlight the technical features which are essential and important for better understanding the present invention.

With reference to FIG. 1, the treadmill 100 comprises a base 101 extending along a longitudinal axis L, indicated by a dashed line in FIG. 1.

The base 101 comprises a first rotating element 102 and a second rotating element 103 adapted to rotate about respective rotational axes, in particular a first rotation axis A2 for the first rotating element 102 and a second rotation axis A3 for the second rotating element 203, transversal to the longitudinal axis L of the base 101 of the treadmill 100.

It is worth noting that the first rotating element 102 is arranged at an end of the base 101, whilst the second rotating element 103 is arranged at a second end of the base 101, opposite to said first end along the longitudinal axis L of the base 101.

The treadmill 100 further comprises a physical exercise surface 104 for the training of a user U (diagrammatically shown in FIG. 1) on the treadmill 100.

In particular, the physical exercise surface 104 is operatively connected to the first rotating element 102 and to the second rotating element 103 of the base 101.

It is worth noting that the physical exercise surface 104, between the first rotating element 102 and the second rotating element 103, has a side profile which is substantially parallel with respect to the longitudinal axis L of the base 101.

For the purposes of the present description, "physical exercise surface" means the rotational surface of the treadmill 100 on which a user U, by placing his or her feet or lower limbs in general, can carry out a physical exercise, such as, for example, running, and also walking or any other type of physical exercise that the treadmill 100 allows.

Running is the physical exercise to which reference will be made in particular for the purposes of the present invention.

Furthermore, it is worth noting that "rotating element" means any mechanical element adapted to rotate about a respective rotation axis so as to impart a rotation to the "physical exercise surface" operatively associated with one or more of these rotating elements.

The type of rotating elements, some examples of which will be described below, depends on the type of physical exercise surface to be rotated.

In greater detail, the rotation of the first rotating element 102 also drives the physical exercise surface 104 and the second rotating element 103 into rotation.

In entirely similar manner, the rotation of the second rotating element 103 drives the first rotating element 102 and the physical exercise surface 104 into rotation.

The physical exercise surface 104 has a development direction DS, shown in figures by a dashed line, and a first feeding direction v1, shown in figures by an arrow, in parallel to the development direction DS of the physical exercise surface 104.

The user U, during the training on the treadmill 100, has a respective movement direction vu, also shown in the figures by an arrow, parallel to the development direction DS of the physical exercise surface 104, opposite to the first feeding direction v1.

In the example of FIG. 1, the first feeding direction v1, parallel to the development direction DS of the physical exercise surface 104, is directed from the first rotating element 102 to the second rotating element 103, while the movement direction vu of the user U, parallel to the development direction DS of the physical exercise surface 104, is directed from the second rotating element 103 to the first rotating element 102.

In an embodiment (not shown in the figure), the physical exercise surface 104 comprises a belt wound about the first rotating element 102 and the second rotating element 103 and a supporting table, arranged between the first rotating element 102 and the second rotating element along the longitudinal axis L of the base 101, on which the belt defining the physical exercise surface 104 runs.

In this embodiment, the first rotating element 102 and the second rotating element 103 comprise two respective rolls, each rotationally coupled to the base 101 of the treadmill 100 at the two ends of the base 101, to which the belt is connected.

Figure 2:
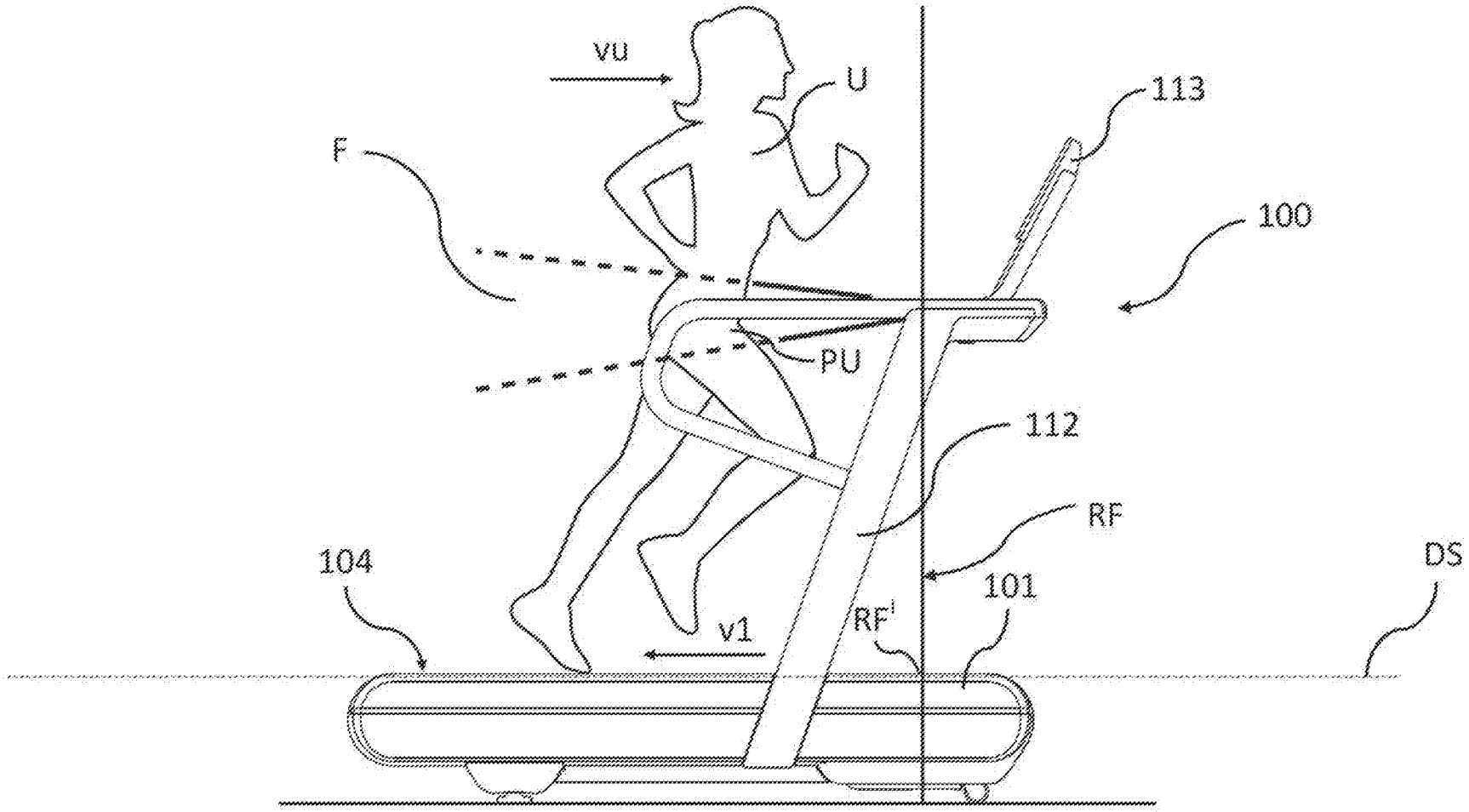
FIGS. 2, 3 and 4 show, respectively, a side view, a top view and a perspective view of a treadmill which can be used by a user for training, according to an embodiment of the present invention.
Figure 3:
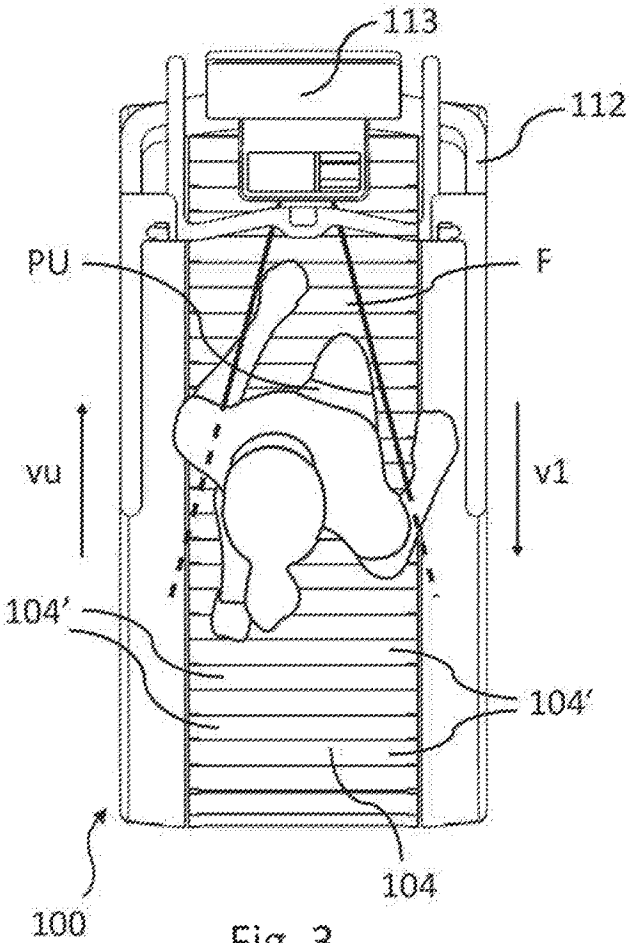

According to a further embodiment, shown in FIG. 2 and partially in FIG. 3, the physical exercise surface 104 comprises a plurality of slats 104' transversal to the longitudinal axis L of the base 101, conferring a so-called slat-like conformation to the physical exercise surface 104.

In this embodiment, both the first rotating element 102 and the second rotating element 103 comprise two respective pulleys arranged near the side portions of the base 101, transversely to the longitudinal axis L of the base 101, adapted to support the plurality of slats 104' at the side edges of each slat.

Furthermore, the physical exercise surface 104, at the side edges of the plurality of slats 104', is supported by respective side guides (also not shown) fixed to the base 101, each comprising, for example, a series of small rolls coupled in a freely rotating way to the base 101 on which the respective side edge of the plurality of slats 104' runs.

Again with reference to the embodiment in FIG. 1, the treadmill 100 further comprises an electronic control unit 200 for the movement of the physical exercise surface 104 of the treadmill 100, hereinafter also electronic control unit 200 for the sake of brevity.

The electronic control unit 200 is configured to execute steps of an adaptive control method of a treadmill 100 in accordance with the present invention, described below.

In this respect, it is worth noting that the operation of the electronic control unit 200 will be described below by making direct reference to the steps of the aforesaid control method executed by the electronic control unit 200.

With reference to FIG. 1, according to an embodiment, the electronic control unit 200 comprises an electric motor 105 and a data processing unit 106 (described below).

The electric motor 105 is operatively connected to the data processing unit 106.

Furthermore, the electric motor 105 is operatively connected to the physical exercise surface 104 to move the physical exercise surface 104, under the control of the data processing unit 106, along the development direction DS of the physical exercise surface 104 in the first feeding direction V1.

In greater detail, the electric motor 105 is, for example, operatively associated with at least one among said first rotating element 102 and second rotating element 103.

Examples of motors may be electric brushless type motors, three-phase asynchronous electric motors, variable reluctance electric motors, direct current electric motors, and so forth.

It is worth noting that in the description which follows and also in FIG. 1, for the sake of convenience, the case in which the electric motor 105 is associated with the first rotating element 102 is considered, since the electric motor 105 could be associated with the second rotating element 103 in equivalent and alternative manner.

The electric motor 105, operatively associated with and controllable by a data processing unit 106 (described below), is configured to assume a rotation speed whereby consequently rotating the first rotating element 102 about the respective rotation axis, i.e. the first rotation axis A2. The rotation of the first rotating element 102 drives the physical exercise surface 104 into rotation, which also rotates the second rotating element 103 about the respective rotation axis, i.e. the second rotation axis A3.

It is worth reiterating that, when the physical exercise surface 104 is in motion, the first feeding direction v1 of the physical exercise surface 104 is opposite to the movement direction vu of the user U.

Again with reference to FIG. 1, the electronic control unit 200, in an embodiment, further comprises a drive 105' operatively connected to the electric motor 105.

The drive 105' is configured to supply an electric current to the electric motor 105 to generate a torque adapted to move the physical exercise surface 104 so that the electric motor 105 and drive 105' assembly can correct the instantaneous rotation speed of the electric motor 105, which is inevitably disrupted by the interaction of the user U with the physical exercise surface 104 while performing the physical activity, returning it as close as possible to a reference instantaneous speed rotation value.

As mentioned above, again with reference to the embodiment in FIG. 1, the electronic control unit 200 further comprises a data processing unit 106, e.g. a microprocessor or a microcontroller.

Furthermore, in this embodiment, the electronic control unit 200 comprises a memory unit 107 operatively connected to the data processing unit 106.

The memory unit 107 can be either internal or external (as shown in FIG. 1, for example) to the data processing unit 106.

It is worth noting that the memory unit 107 is configured to store one or more program codes which can be executed by the data processing unit 106 and data generated by said one or more program codes.

The electronic data processing unit 106 is configured to allow the electronic control unit 200 to execute the steps of an adaptive method of a treadmill 100 in accordance with the present invention, described below.

In accordance with an embodiment (shown in FIG. 1), the data processing unit 106 further comprises a first data processing block 108, e.g. a microprocessor or a microcontroller, operatively connected to the electric motor 105.

It is worth noting that in this embodiment, the first data processing block 108 may coincide with the microprocessor of the drive 105' of the electric motor 105.

In this embodiment, the memory unit 107 comprises a first memory block 109 operatively connected to the first data processing block 108.

In this embodiment, some steps of the adaptive control method of a treadmill 100 which can be executed by the electronic control unit 200 and described below, are executed by the first data processing block 108, e.g. by the microcontroller of the drive 105' of the electric motor 105.

In accordance with a further embodiment, in combination with the preceding one (shown by dashed lines in FIG. 1), the data processing unit 106 further comprises a second data processing block 110, e.g. a microprocessor or a microcontroller, operatively connected to the first data processing block 108.

The second data processing block 110 is remote with respect to the first data processing block 108.

For example, the second data processing block 110 may be positioned in an electronic control unit of a user interface 112, the latter described below, with which the treadmill 100 is provided.

In this embodiment, the memory unit 107 comprises a second memory block 111 operatively connected to the second data processing block 110, also positioned in the control electronics of the user interface 112 of the treadmill 100.

The data link between the first data processing block 108 and the second data processing block 110 may be wired or wireless (e.g. by Bluetooth, NFC or Wi-Fi type data communication channel).

According to an embodiment, all the steps of the adaptive control method of a treadmill 100, which can be executed by an electronic control unit 200 and described below, are performed exclusively by the first data processing block 108, e.g. by the microcontroller of the drive 105' of the electric motor 105.

According to an embodiment, alternative to the preceding one, the steps of the adaptive control method of a treadmill 100 in accordance with the present invention, described below, can be performed exclusively by the second data processing block 110.

In a further embodiment, alternative to the previous ones, a first plurality of steps of the aforesaid method can be performed by the first data processing block 108, while a second plurality of steps of the same method can be performed by the second data processing block 110.

By way of example, the second data processing block 110 may generate the commands to be provided to the electric motor 105, while the first data processing block 108, i.e. for example the microcontroller of the drive 105' of the electric motor 105, can impart to the electric motor 105 the commands generated by and received from the second data processing block 110.

In this manner, it is advantageously possible to reduce the task, from a computational point of view, of the first processing block 108 which, corresponding for example to the microcontroller of the drive of the treadmill 100, is configured to supply the electric current to the electric motor 105 to generate the torque adapted to move the physical exercise surface 104 so that the electric motor 105 and drive 105' assembly can correct the instantaneous rotation speed of the electric motor 105', inevitably disrupted by the interaction of the user U with the physical exercise surface 104 while performing the physical activity, returning it as close as possible to an instantaneous speed rotation reference value.

With reference now in particular to FIGS. 2-5, 6*a*, 6*b*, 7*a*, 7*b*, 6*a*', 6*b*', 7*a*', 7*b*', according to an embodiment, in combination with any one of those described above or in combination therewith, the treadmill 100 further comprises a frame 112 extending substantially in vertical direction with respect to the base 101.

The frame 112 is a combination of uprights and tubular elements operatively connected to one another and distributed so as to define a supporting structure which at least in part surrounds the user U when he or she is on the physical exercise surface 104 (as shown in the aforesaid figures).

Figure 4:
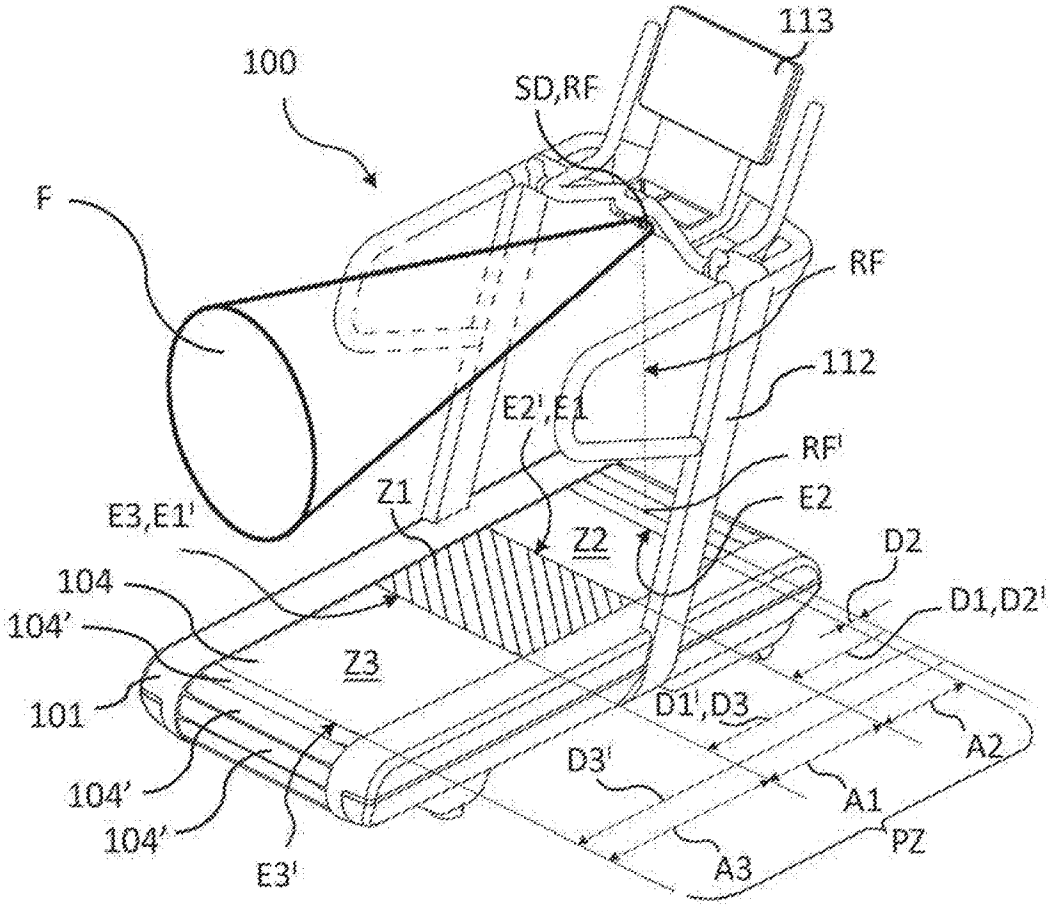

According to a further embodiment, in combination with any one of those described above or in combination therewith, shown again for example in FIGS. 1 and 4, the treadmill 100 further comprises a distance sensor SD, e.g. an infrared sensor, operatively connected to the electronic control unit 200 of the movement of the physical exercise surface 104 of the treadmill 100 (the latter only shown in FIG. 1).

In more detail, as shown in FIG. 1, the distance sensor SD is operatively connected to the data processing unit 106 of the electronic control unit 200.

The distance sensor SD is configured to detect a distance value of a portion PU of the user U from a reference point RF arranged on the treadmill 100, while performing the physical activity on the treadmill 100.

For the purposes of the present description, "portion of the user" means a part of the body above the lower limbs, preferably the lower part of the trunk at the pelvis or the navel.

Reference point RF coincides with the distance sensor SD (as shown in FIG. 4).

However, it is worth noting that in FIGS. 2, 5, 6*a*, 6*b*, 7*a*, 7*b*, 6*a*', 6*b*', 7*a*', 7*b*', in which the distance sensor SD is not shown, reference RF is used to indicate a straight line passing through the reference point coinciding with the distance sensor SD and projection RF' of such reference point on a reference plane represented by the physical exercise surface 104. The straight line indicated by reference RF is also orthogonal to the development direction DS of the physical exercise surface 104.

It is worth noting that for the sake of uniformity, the straight line indicated by reference RF is also shown in FIG. 4, although the distance sensor is also shown (indicated in this figure by both references SD and RF).

Again with reference to FIGS. 2, 3 and 4, the distance sensor SD is, for example, fixed to the front part of the frame 112 of the treadmill 100, preferably in the center and is positioned so that the emitted detection beam (indicated by reference F) is substantially parallel to the development direction DS of the physical exercise surface 104 so as to strike the PU portion of the user U, as defined above, and to be reflected towards a detection region of the distance sensor SD itself.

As previously mentioned, according to an embodiment, shown for example in FIGS. 2-5, 6*a*, 6*b*, 7*a*, 7*b*, 6*a*', 6*b*', 7*a*', 7*b*', the treadmill 100 further comprises a user interface 113 operatively connected to the electronic control unit 200 of the movement of the physical exercise surface 104 of the treadmill 100.

In greater detail, the user interface 113 is operatively connected to the data processing unit 106 of the electronic control unit 200.

In this regard, the user interface 113 may be connected to the data processing unit 106 according to different methods described above, in accordance with various embodiments.

The user interface 113 comprises a display and a control console configured to allow the user to impart commands to the treadmill 100.

In an embodiment, if the display is of the touchscreen type, the control console may coincide with the display of the user interface 113.

It is worth noting that the display of the user interface 113 allows the user U to be able to view both content specific to the use of the treadmill 100, including content correlated to the adaptive control method, which will be described below, and entertainment or user service multimedia content.

In this regard, each of FIGS. 8*a*, 8*b*-8*e*, 8*f*, 8*b*'-8E' shows graphic content which can be viewed by the user interface 113 in different operating modes of use of the adaptive control method of the treadmill 100.

FIGS. 8*a*, 8*b*-8*e*, 8*f*, 8*b*'-8*e*' will be illustrated in detail hereinafter during specific description of the adaptive control method of the treadmill according to the present invention.

With reference now to the figures illustrated hereto and also to the block charts of FIGS. 9 and 10, a adaptive control method 900 of a treadmill 100, hereinafter also simply method, according to an embodiment of the present invention, is now described.

The method 900 comprises, in a current time instant $t_i$, with $1<i<N$, of a plurality of time instants $t_1, T_2, \ldots, T_N$, a step of a) dividing 901, by an electronic control unit 200 of the movement of a physical exercise surface 104 of the treadmill 100, the physical exercise surface 104 of the treadmill 100 facing a user U during exercise on the treadmill 100, into a plurality PZ of control zones of the treadmill 100 as a function of a distance from a reference point RF arranged on a treadmill 100.

In relation to the plurality of time instants $t_1, T_2, \ldots, T_N$, it is worth noting that the distance in time between the aforesaid time instants depends on the sampling frequency with which the electronic control unit 200 is configured in order to execute the method 900.

As said above, the physical exercise surface 104 has a development direction DS and a first feeding direction v1 parallel to the development direction DS.

With particular reference to FIGS. 4, 5, 6*a*, 6*b*, 7*a*, 7*b*, 6*a*', 6*b*', 7*a*', 7*b*' and 8*a*, 8*b*-8*e*, 8*f*, 8*b*'-8E', in an embodiment, the plurality PZ of control zones along the development direction DS of the physical exercise surface 104 comprises at least a first control zone Z1 having a respective first width A1 along the development direction DS of the physical exercise surface 104.

The first width A1 is comprised between a first boundary line E1 and a second boundary line E1'.

The first boundary line E1 is at a first distance D1 from the reference point RF.

The second boundary line E1' is at a second distance D1' from the reference point RF. The second distance D1' is greater than the first distance D1.

It is worth noting that, in the figures, the distance from the reference point RF of any boundary line defined in the plurality PZ of control zones is defined as the distance along the development direction DS of the physical exercise surface 104 of the projection of the reference point RF (coinciding with the distance sensor SD) on the physical exercise surface 104.

The plurality PZ of control zones along the development direction DS of the physical exercise surface 104 further comprises at least a second control zone Z2 having a respective second width A2 along the development direction DS of the physical exercise surface 104.

The second width A2 is comprised between a third boundary line E2 and a fourth boundary line E2'.

The third boundary line E2 is at a third distance D2 from the reference point RF.

The fourth boundary line E2' is at a fourth distance D2' from the reference point RF. The fourth distance D2' is greater than the third distance D2.

It is worth noting that the fourth boundary line E2' of said at least a second control zone Z2 coincides with the first boundary line E1 of said at least a first control zone Z1.

For the purposes of the present description, it is worth noting that the at least a first control zone Z1 was defined so that, if the distance value $dU(t_i)$ of the portion PU of the user U from the reference point RF is such as to be comprised between the first boundary line E1 and the second boundary line E1' of the at least a first control zone Z1, the electronic control unit 200 is configured to maintain a constant feeding speed of the physical exercise surface 104 (while maintaining a constant rotation speed of the electric motor 105 with which the feeding speed of the physical exercise surface 104 is correlated).

Therefore, as reasserted below, the at least a first control zone Z1 is also named comfort zone because by running inside it the user U can maintain a substantially constant training speed.

It is worth noting that the boundary lines of each control zone (the at least a first control zone Z1, the at least a second control zone Z2 and the additional control zones which will be introduced and described below) have a respective distance from the reference point RF which is dynamic in time, i.e., as will be described below, which at each time instant after the current time instant $t_i$ can maintain the same value or be modified to assume a different value, according to the operating mode that the treadmill 100 can assume during the execution of the method 900.

Turning back to FIGS. 9 and 10, the method 900 further comprises, in a current time instant $t_i$ of a plurality of subsequent time instants $t_1, t_2, \ldots, t_N$, a step of b) detecting (902), by the electronic control unit 200 for the movement of the physical exercise surface 104 of the treadmill 100, a distance value $dU(t_i)$ of the portion PU of the user U from the reference point RF.

It is worth noting that the step of b) detecting is performed by using the distance sensor SD operatively connected to the electronic control unit 200, as described above.

In this regard, again in the current time instant $t_i$ of a plurality of subsequent time instants $t_1, t_2, \ldots, t_N$, the method 900 comprises a step of c) comparing 903, by the electronic control unit 200 for the movement of the physical exercise surface 104 of the treadmill 100, the distance value $dU(t_i)$ detected with the first distance D1 of the first boundary line E1 of the at least a first control zone Z1.

Figure 8A:
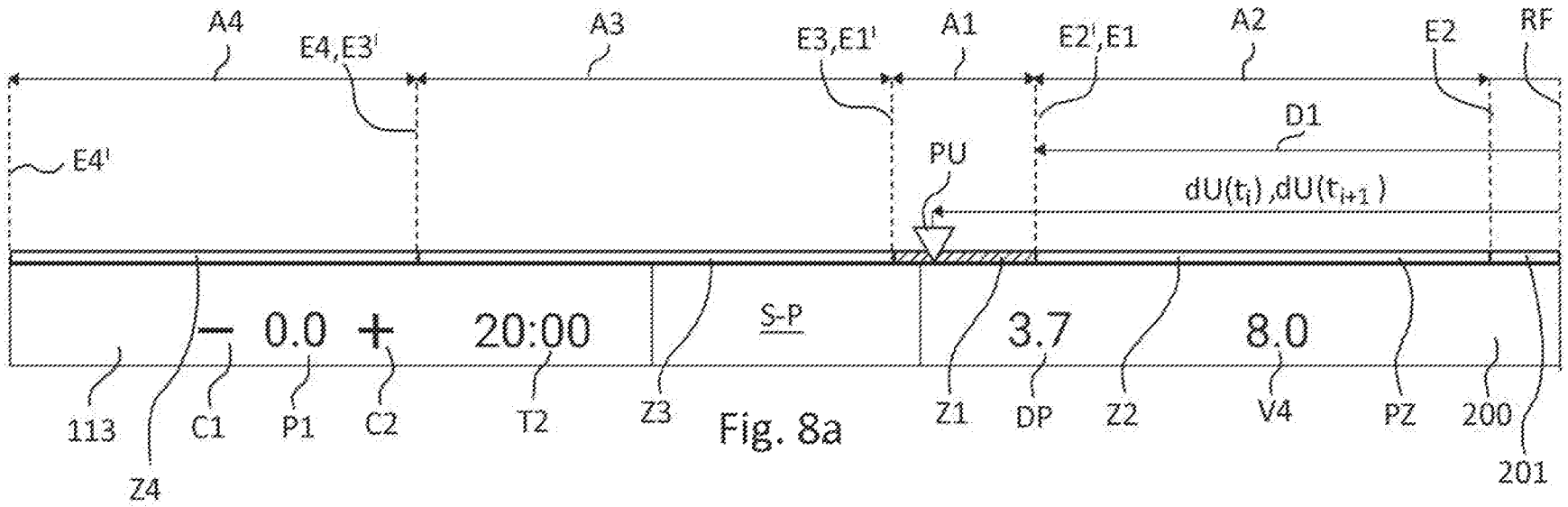
FIG. 8*a* diagrammatically shows a portion of a graphic interface of the treadmill in an operating mode of the adaptive control method of a treadmill according to an embodiment of the present invention.
Figure 8B:
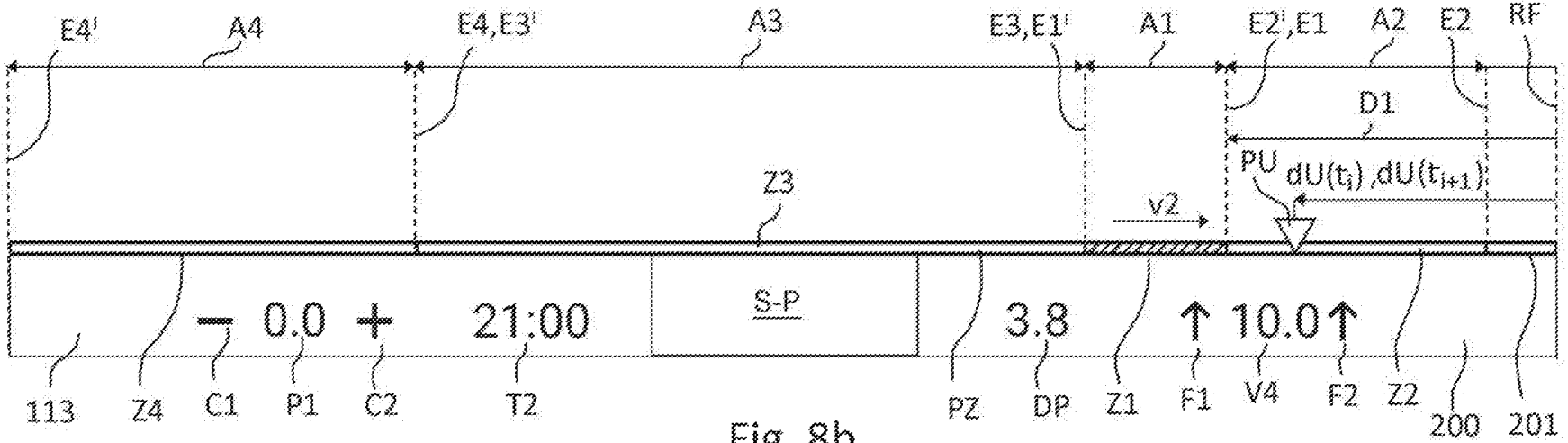
FIGS. 8*b* and 8*c* diagrammatically show a portion of a graphic interface of the treadmill in subsequent operating modes of the adaptive control method of a treadmill according to an embodiment of the present invention.
Figure 8C:
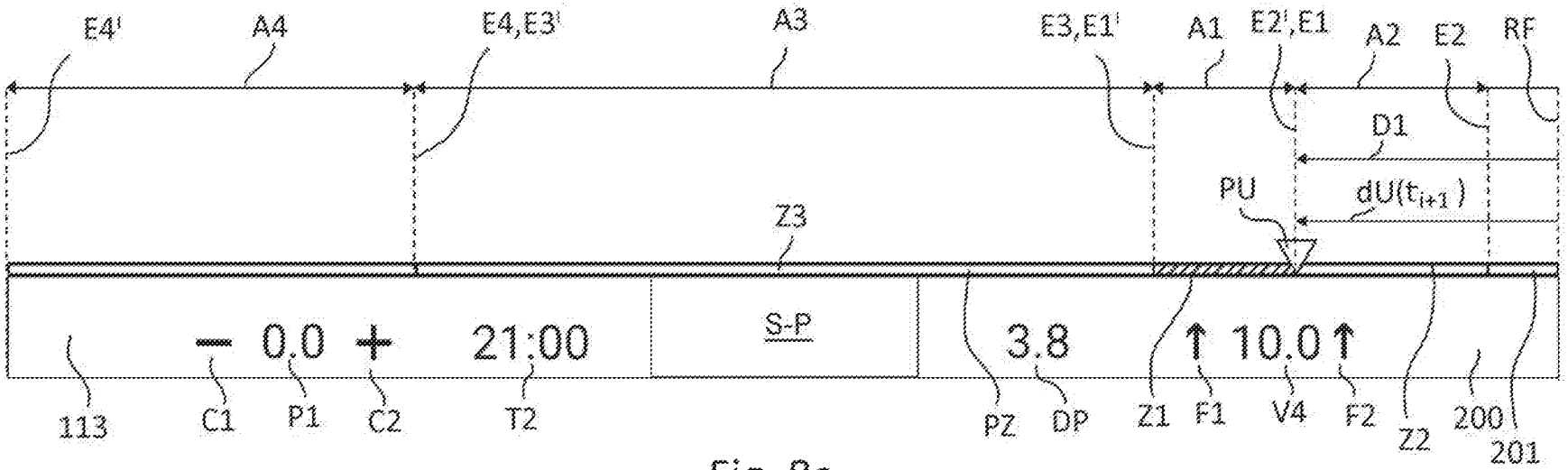
Figure 9:
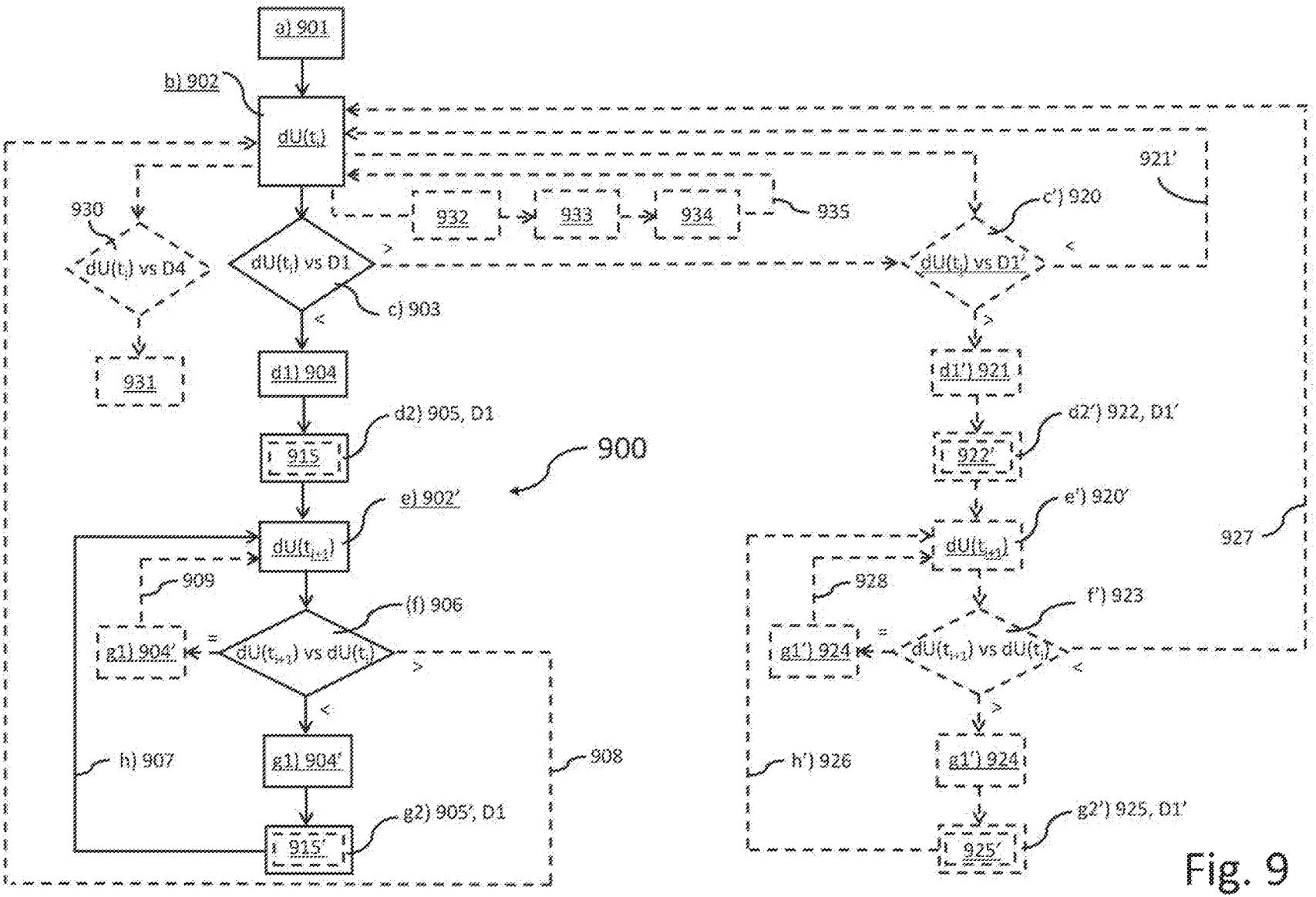
FIG. 9 shows, by a block chart, an adaptive control method of a treadmill, according to an embodiment of the present invention.
Figure 10:
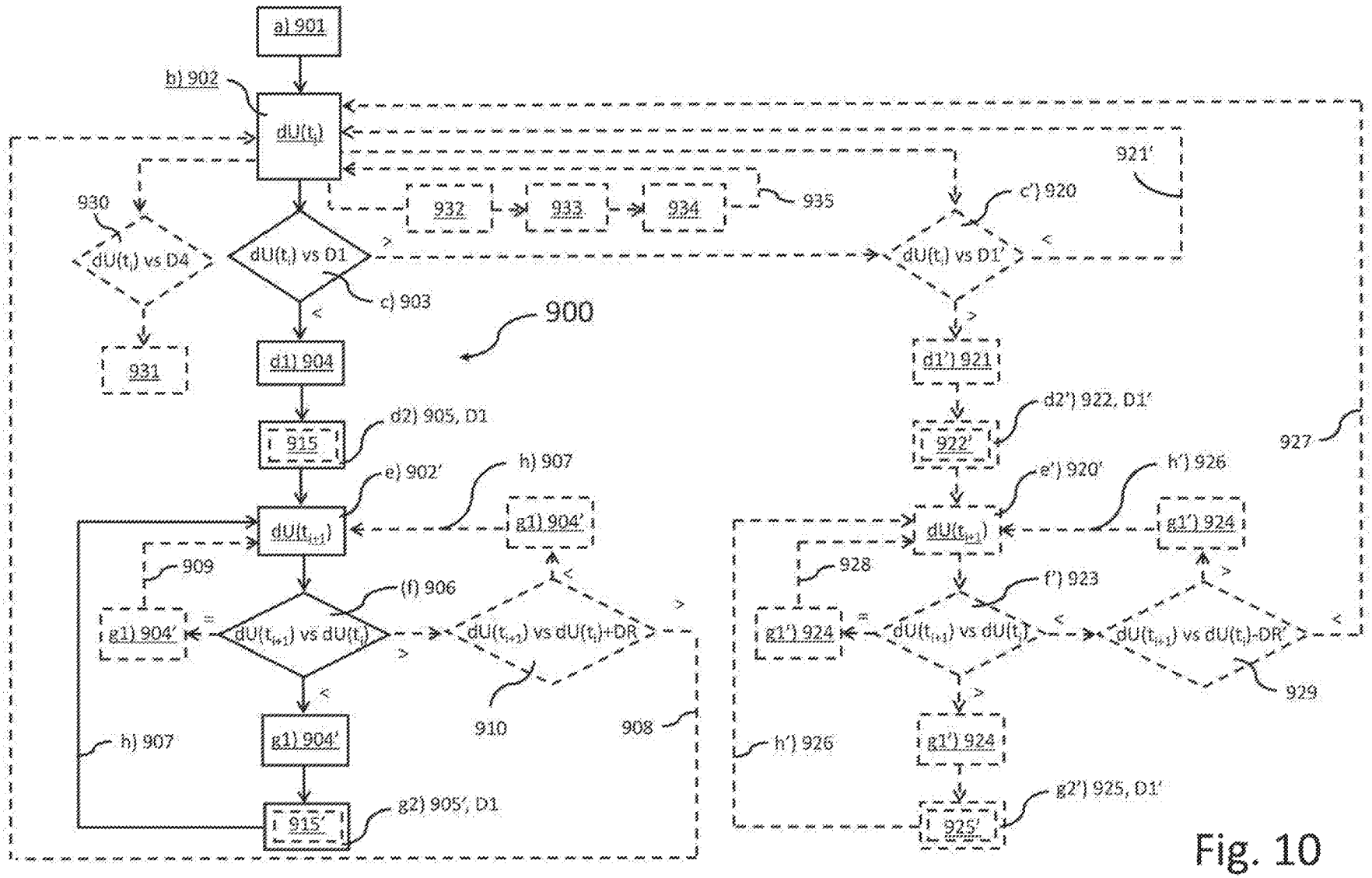
FIG. 10 shows, by a block chart, an adaptive control method of a treadmill, according to a further embodiment of the present invention.

At the current time instant $t_i$ of the plurality of time instants $t_1, T_2, \ldots, T_N$, if the detected distance value $dU(t_i)$ is smaller than the first distance D1 of the first boundary line E1 (FIGS. 6*a*, 6*b* and 8*b*, 8*c*), the method 900, in an embodiment, shown both in FIG. 9 and in FIG. 10, further comprises a step of:

d1) controlling 904, by the electronic control unit 200 of the movement of the physical exercise surface 104 of the treadmill 100, an increase in the feeding speed of the physical exercise surface 104 (by increasing the rotation speed of the electric motor 105 with which the feeding speed of the physical exercise surface 104 is correlated).

The fact that, during the training on the physical exercise surface 104 of the treadmill 100, the distance value $dU(t_i)$ detected in the current time instant $t_i$ is smaller than the first distance D1 of the first boundary line E1 of the at least a first control zone Z1 means that the portion PU of the user U is located in the at least a second control zone Z2.

For this reason, considering that the feeding speed of the physical exercise surface 104 is increased in automatic and adaptive manner in such condition, the at least a second control zone Z2 can also be defined as "acceleration zone" of the physical exercise surface 104.

Furthermore, again in the current time instant $t_i$ of the plurality of time instants $t_1, t_2, \ldots, t_N$, if the detected distance value $dU(t_i)$ is smaller than the first distance D1 of the first boundary line E1 (FIGS. 6*a*, 6*b* and 8*b*, 8*c*), the method 900, in an embodiment, shown both in FIG. 9 and in FIG. 10, subsequent to the step d1) of controlling 904 further comprises a step of:

d2) modifying 905, by the electronic control unit 200 for the movement of the physical exercise surface 104 of the treadmill 100, the first distance D1 of the first boundary line E1 of the at least a first control zone Z1 from a first value to a second value, along the development direction DS of the physical exercise surface 104 in a second feeding direction v2 opposite to the first feeding direction v1 of the physical exercise surface 104. The second value is either greater than or equal to the detected distance value $dU(t_i)$.

In an embodiment, shown in FIGS. 9, 6*a*, 6*b*, 8*b*, 8*c*, the step d2) of modifying 905 is performed until the second value of the first distance D1 of the first boundary line E1 of the at least a first control zone Z1 is equal to the distance value $dU(t_i)$ detected in the current time instant $t_i$ ($D1=dU(t_i)$).

Figure 6A:
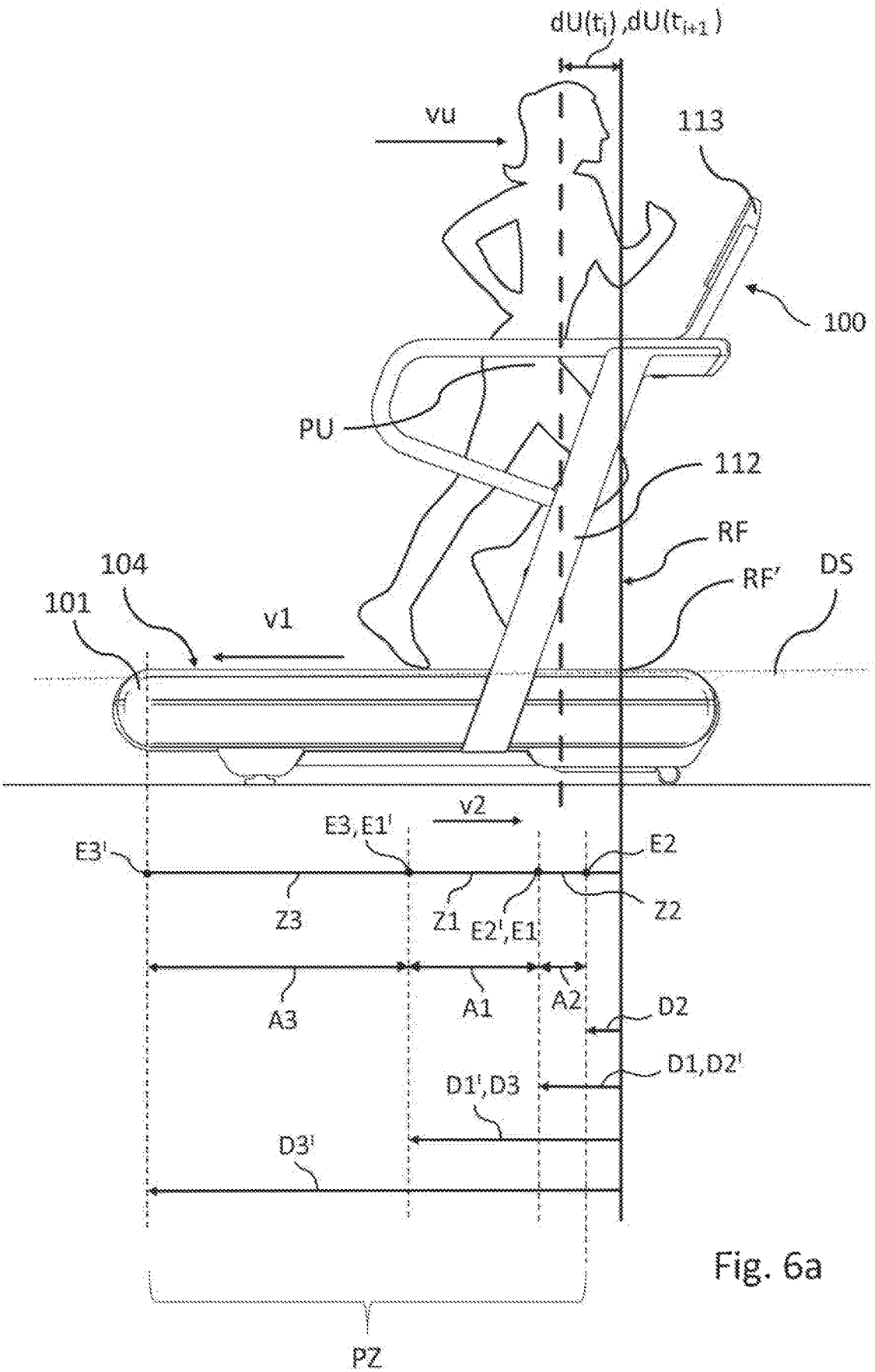
FIGS. 6*a* and 6*b* diagrammatically show a treadmill used by a user in subsequent operating modes during the execution of a step of the adaptive control method of a treadmill according to an embodiment of the present invention.
Figure 6B:
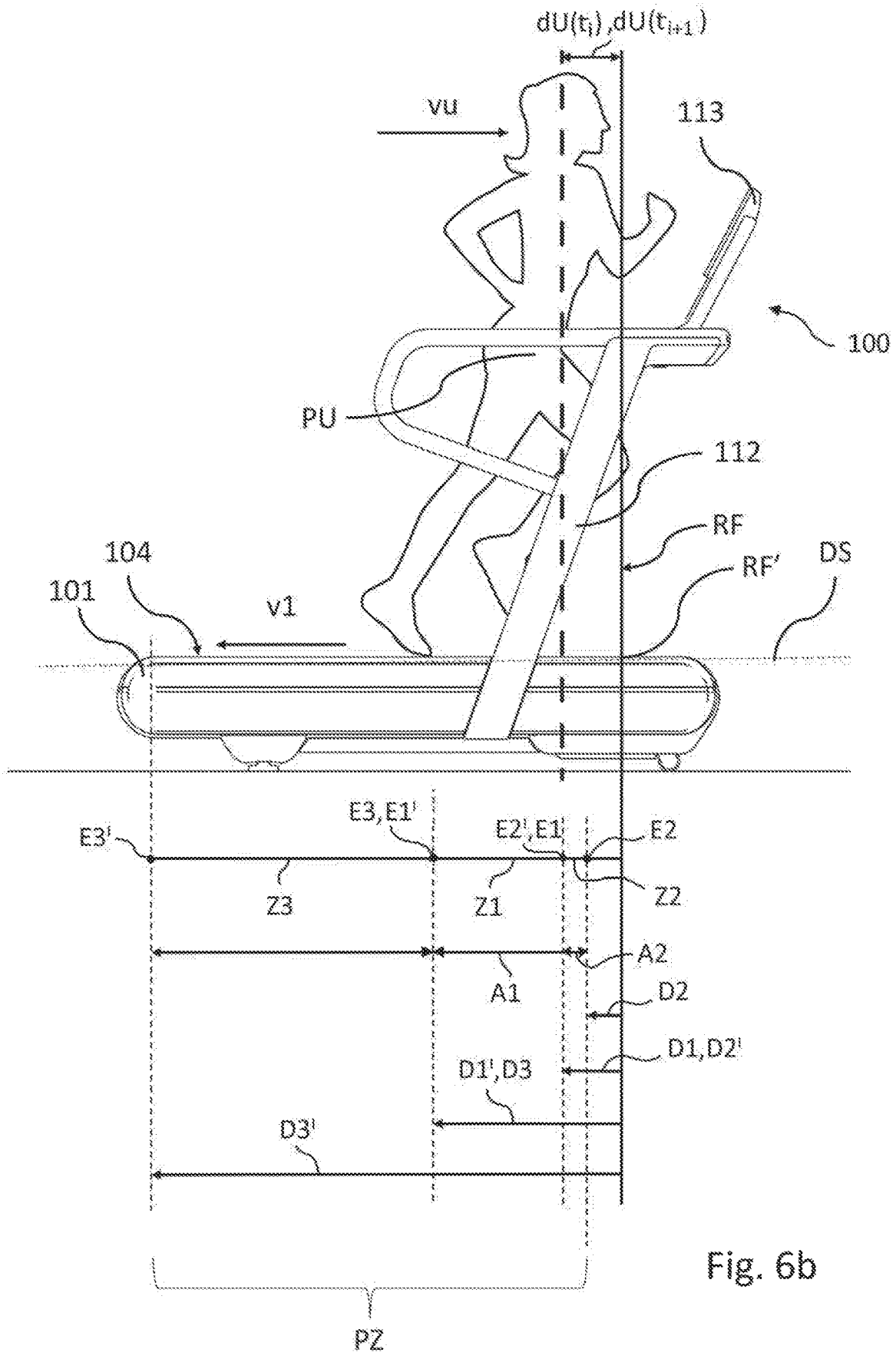

In greater detail, FIGS. 6*a* and 8*b*, respectively, show the first distance D1 of the first boundary line E1 of the at least a first control zone Z1 during its modification (displacement), along the development direction DS of the physical exercise surface 104, in the second direction v2 opposite to the first feeding direction v1 of the physical exercise surface 104, while FIGS. 6*b* and 8*c* illustrate, respectively, the first distance D1 of the first boundary line E1 of the at least a first control zone Z1 at the end of its modification (displacement) in which the modified first distance D1 assumes a respective value equal to the distance value $dU(t_i)$ detected in the current time instant $t_i$.

With particular reference to FIGS. 8*b* and 8*c*, each shows a portion of the display of the user interface 113, which shows a graphic content to the user comprising a first graphic bar 200 and a second graphic bar 201.

The first graphic bar 200, in the example of FIGS. 8*b* and 8*c*, from left to right, comprises:

- a first piece of information P1 representing the slope of the treadmill ("0.0" in the example, in FIGS. 8*b* and 8*c*);
- controls C1, C2 of touchscreen type for varying the slope ("+" for increasing the slope and "−" for decreasing the slope, in the example of FIGS. 8*b* and 8*c*);
- a second piece of information T2 representing the time elapsed since the beginning of the training ("21:00" minutes, in the example of FIGS. 8*b* and 8*c*);
- a stop/pause control S-P (e.g. of touchscreen type);
- a third piece of information DP representing the distance traveled from the beginning of the training ("3:8" kilometers, in the example in FIGS. 8*b* and 8*c*);
- a fourth piece of information V4 representing the feeding speed of the physical exercise surface, correlated with the rotation speed of the electric motor 105 ("10.0" kilometers per hour in the example in FIGS. 8*b* and 8*c*);
- graphic indications F1, F2 representing the increase or decrease in automatic and adaptive manner of the feeding speed of the physical exercise surface 104, correlated with the rotation speed of the electric motor 105 (in the example in FIGS. 8*b* and 8*c*, these indications are arrows arranged at the sides of the fourth piece of information v4 representing the feeding speed of the physical exercise surface; in this step of the method 900, the arrows F1, F2 are directed upwards because they relate to the case in which the feeding speed of the physical exercise surface increases in automatic and adaptive manner).

The second graphic bar 201, adjacent to the first graphic bar 200 and placed above it, comprises a representation of the plurality PZ of control zones and a slider PU (in the example of FIGS. 8*b* and 8*c*, represented with a triangle with one vertex pointing downwards) representing the position of the portion PU of the user U on the physical exercise surface 104 with respect to the reference point RF, corresponding to the detected distance value $dU(t_i)$.

In greater detail, in the example in FIGS. 8*b* and 8*c*, from right to left, the second graphic bar 201 comprises:

the at least a second control zone Z2 with the slider PU inside;

the at least a first control zone Z1;

at least a third control zone Z3 and at least a fourth control zone Z4, described below.

In a further embodiment, alternative to the preceding one and shown in FIGS. 10, 6*a*', 6*b*', 8*b*', 8*c*' (described below), the step of d2) of modifying 905 is performed until the second value of the first distance D1 of the first boundary line E1 of the at least a first control zone Z1 is equal to a first reference distance value $dU(t_i)+DR$ corresponding to the distance value $dU(t_i)$ detected in the current time instant $t_i$ to which a value corresponding to a first minimum reference distance DR is added ($D1=dU(t_i)+DR$).

It is worth noting that the first minimum reference distance DR is represented in FIGS. 6*a*', 6*b*' and 8*b*', 8*c*'.

Turning back, in general, to both FIG. 9 and FIG. 10, in an embodiment, in combination with the one described above, the method 900, in a current time instant $t_{i+1}$ subsequent to the preceding time instant (ex current time instant) $t_i$, comprises steps of:

e) detecting 902', by the electronic control unit 200 for the movement of the physical exercise surface 104 of the treadmill 100, a distance value $dU(t_{i+1})$ of the portion PU of the user U from the reference point RF;

f) comparing 906, by the electronic control unit 200 for the movement of the physical exercise surface 104 of the treadmill 100, the detected distance value $dU(t_{i+1})$ with the distance value $dU(t_i)$ detected in the preceding time instant $t_i$.

It is worth noting that also in this case, the step of b) detecting 902' is performed by using the distance sensor SD operatively connected to the electronic control unit 200.

Again in the current time instant $t_{i+1}$, if the detected distance value $dU(t_{i+1})$ is smaller than the distance value $dU(t_i)$ detected in the preceding time instant $t_i$, the method (900) further comprises steps of:

g1) controlling 904', by the electronic control unit 200 for the movement of the physical exercise surface 104 of the treadmill 100, an increase in the feeding speed of the physical exercise surface 104;

g2) modifying (905'), by the electronic control unit 200 for the movement of the physical exercise surface 104 of the treadmill 100, the first distance D1 of the first boundary line E1 of the at least a first control portion Z1 from a first value to a second value, along the development direction DS of the physical exercise surface 104, in a second feeding direction v2 opposite to the first feeding direction v1. The second value is either greater than or equal to the detected distance value $dU(t_{i+1})$;

It is worth noting that the steps just described are shown again in FIGS. 6*a*, 6*b* and 8*b*, 8*c*, were described above, wherein the distance value $dU(t_{i+1})$ (which is also indicated in the figures above) detected in the current time instant $t_{i+1}$ may be considered instead of the distance value $dU(t_i)$ detected in the preceding time instant $t_i$.

The fact that, while training on the physical exercise surface 104 of the treadmill 100, the distance value $dU(t_{+1})$ detected in the current time instant $t_{i+1}$ is smaller than the distance value $dU(t_i)$ detected in the preceding time instant $t_i$ means that the portion PU of the user U is at a smaller distance also of the first distance D1 as modified in the preceding time instant $t_i$.

Therefore, the portion PU of the user is still in the at least a second control zone Z2, i.e. in the "acceleration zone".

For this reason, the physical exercise surface 104 is still subject, by the electronic control unit 200, to an increase of the feeding speed in automatic and adaptive manner.

Furthermore, the fact that, during the training on the physical exercise surface 104 of the treadmill 100, the distance value $dU(t_{+1})$ detected in the current time instant $t_{i+1}$ is smaller than the distance value $dU(t_i)$ detected in the preceding time instant $t_{the}$ implies the modification (displacement), also in the time instant $t_{i+1}$, of the first distance D1 of the first boundary line E1 of the at least a first control zone Z1 in the second direction v2 opposite to the first feeding direction v1 so as to either follow or reach the detected distance value $dU(t_{i+1})$, advantageously allowing the first boundary line E1 of the at least a first control zone Z1 to follow the portion PU of the user.

In this manner, the method 900 advantageously ensures that the at least a first control zone Z1 ("comfort zone") follows as much as possible the movement of the user U on the physical exercise surface 104 so as to allow the user U him or herself to return from the at least a second control zone Z2 ("acceleration zone") to a detected distance value $dU(t_{i+1})$ such as to fall between the first boundary line E1 and the second boundary line E1' of the at least a first control zone Z1 ("comfort area") by promptly controlling the treadmill 100 in a more precise and safe manner, consequently making the training of the user U safer and more accurate.

It is worth noting that in an embodiment, shown in FIGS. 9, 6*a*, 6*b*, 8*a*, 8*b*, the step g2) of modifying 905' is performed until the second value of the first distance D1 of the first boundary line E1 of the at least a first control zone Z1 is equal to the distance value $dU(t_{i+1})$ detected in the current time instant $t_{i+1}$ ($D1=dU(t_{i+1})$).

In greater detail, also in this case, FIGS. 6*a* and 8*b* respectively show the first distance D1 of the first boundary line E1 of the at least a first control zone Z1 during its (displacement), along the development direction DS of the physical exercise surface 104, in the second direction v2 opposite to the first feeding direction v1 of the physical exercise surface 104, while FIGS. 6*b* and 8*c* illustrate, respectively, the first distance D1 of the first boundary line E1 of the at least a first control zone Z1 at the end of its modification (displacement) in which the modified first distance D1 assumes a respective value equal to the distance value $dU(t_{i+1})$ detected in the current time instant $t_{i+1}$.

In a further embodiment, alternative to the preceding one and shown in FIGS. 10, 6*a*', 6*b*', 8*b*', 8*c*' (described below), the step g2) of modifying 905' is performed until the second value of the first distance D1 of the first boundary line E1 of the at least a first control zone Z1 is equal to a first reference distance value $dU(t_{i+1})+DR$ corresponding to the distance value $dU(t_{i+1})$ detected in the current time instant $t_{i+1}$ to which a value corresponding to a first minimum reference distance DR is added ($D1=dU(t_{i+1})+DR$).

Turning back to the last embodiment described, shown in FIG. 9 and in FIG. 10, the method 900, at the current time instant $t_{i+1}$, comprises a step of:

h) returning 907, by the electronic control unit 200 for the movement of the physical exercise surface 104 of the treadmill 100, to the step of e) detecting 902' to perform the method 900 starting from the step of e) detecting 902' in time instants subsequent to the current time instant $t_{i+1}$.

So, according to the method of the present invention, at each time instant of the plurality of time instants $t_1$, $t_2$, . . . , $t_N$, the electronic control unit 200 resumes the execution of the step of e) detecting 902' and continues the method by comparing the distance value $dU(t_{i+1})$ detected in the current time instant $t_{i+1}$ with the distance value $dU(t_i)$ detected in the preceding time instant $t_i$ and the first distance D1 as modified in the last preceding time instant in which it was necessary to change the first distance D1 (step g2) of modifying 905').

In an embodiment, shown in FIG. 9 by dashed lines, in combination with the preceding one, in the current time instant $t_{i+1}$ subsequent to the preceding time instant $t_i$, following the step of f) comparing 906, if the distance value $dU(t_{i+1})$ detected in the current time instant $t_{i+1}$ is greater than the distance value $dU(t_i)$ detected in the preceding time instant $t_i$, the method 900 comprises a step of returning 908, by the electronic control unit 200 for the movement of the physical exercise surface 104 of the treadmill 100, to the step of b) detecting 902 to perform the method 900 starting from the step of b) detecting 902 in time instants subsequent to the current time instant $t_{i+1}$.

It is worth noting that from this moment on, the subsequent step of c) comparing 903 compares the value of distance $dU(t_{i+1})$ detected again in the step of b) detecting 902 with the first distance D1 modified in the last preceding time instant in which it was necessary to change the first distance D1 (step of g2) modifying 905').

In an embodiment, also shown in FIG. 9 by dashed lines, in combination with any one of the preceding ones or in combination therewith, in the current time instant $t_{i+1}$ subsequent to the preceding time instant $t_i$, following the step of f) comparing 906, if the distance value $dU(t_{i+1})$ detected in the current time instant $t_{i+1}$ is equal to the distance value $dU(t_i)$ detected in the preceding time instant $t_h$ the method 900 comprises a step of g1) controlling 904', by the electronic control unit 200 for the movement of the physical exercise surface 104 of the treadmill 100, an increase of the feeding speed of the physical exercise surface 104.

Furthermore, in this embodiment, the method 900 comprises a step of returning 909, by the electronic control unit 200 for the movement of the physical exercise surface 104 of the treadmill 100, to the step of e) detecting 902' to perform the method 900 starting from the step of e) detecting 902' in time instants subsequent to the current time instant $t_{i+1}$.

It is worth noting that in this embodiment, in which the user U always maintains the same position with respect to the reference point RF, inside the at least a first control zone Z1, the method 900 includes continuing to increase the feeding speed of the physical exercise surface 104 (step of g1) controlling 904') without further modifying the first distance D1 of the first boundary line E1 of the at least a first control zone Z1.

In an embodiment, in combination with any one of those described above or in combination therewith, in the step of d1) controlling 904 and in the step of g1) controlling 904', the increase in the feeding speed of the physical exercise surface 104 is an acceleration of the physical exercise surface 104, the value of which is a function of the feeding speed value of the physical exercise surface 104 from which the acceleration starts, i.e. the instantaneous speed value of the physical exercise surface 104 in the time instant $t_i$ and in the time instant $t_{i+1}$, respectively, in which the passage occurs from the at least a first control zone Z1 to the at least a second control zone Z2 ($dU(t_i)$ and $dU(t_{i+1})$, respectively, smaller than the first distance D1 of the first boundary line E1).

In greater detail, the acceleration value of the physical exercise surface 104 imparted by the electronic control unit 200 is a function of the feeding speed value of the physical exercise surface 104 as follows: the higher the feeding speed value of the physical exercise surface 104 from which the acceleration starts, the smaller is the imparted acceleration value of the physical exercise surface 104.

In other words, if the feeding speed value of the physical exercise surface 104 from which the acceleration starts is already high, the acceleration value of the physical exercise surface 104 imparted by the electronic control unit 200 will be lower than the case in which the feeding speed of the physical exercise surface 104 from which the acceleration starts is lower.

Therefore, in this embodiment, it is possible to advantageously control the acceleration of the physical exercise surface 104 in the respective "acceleration zone" with a linear law variation with respect to the feeding speed of the physical exercise surface 104 from which the acceleration starts or, in an equivalent manner, by how much the user U passes from at least a first control zone Z1 to the at least a second control zone Z2, passing beyond the first boundary line E1 of the at least a first control zone Z1 (or fourth boundary line E2' of the at least a second control zone Z2).

According to an embodiment, either in combination with or as an alternative to the preceding one, in step of d1) controlling 904 and in the step of g1) controlling (904'), the increase of the feeding speed of the physical exercise surface 104 is an acceleration, the value of which is inversely proportional to the detected distance value ($dU(t_i)$ or $dU(t_{i+1})$) of the portion PU of the user U from the reference point RF arranged on the treadmill 100.

In other words, the smaller is the distance of the user U from the reference point RF, the greater is the acceleration to which the physical exercise surface 104 is subjected.

Therefore, in this embodiment, it is possible to advantageously control the acceleration of the physical exercise surface 104 in the respective "acceleration zone" in manner linearly dependent on the distance of the user U from the reference point RF (distance sensor SD).

According to an embodiment, shown by dashed lines in FIG. 10 and also shown in FIGS. 6*a*', 6*b*' and 8*b*', 8*c*', in combination with any one of those described above or in combination therewith, in the current time instant $t_{i+1}$ subsequent to the preceding time instant $t_h$ following the step of f) comparing 906, by the electronic control unit 200 for the movement of the physical exercise surface 104 of the treadmill 100, the distance value $dU(t_{i+1})$ with the distance value $dU(t_i)$ detected in the preceding time instant $t_i$, if the distance value $dU(t_{i+1})$ is greater than the distance value $dU(t_i)$ detected in the preceding time instant $t_h$ the method 900 comprises a step of:

comparing 910, by the electronic control unit 200 for the movement of the physical exercise surface 104 of the treadmill 100, the distance value $dU(t_{i+1})$ detected in the current time instant $t_{i+1}$ with a first reference distance value $dU(t_i)$+DR corresponding to the distance value $dU(t_i)$ detected in the preceding time instant $t_i$ to which a value corresponding to the first minimum reference distance DR is added.

In this regard, FIGS. 8*b*' and 8*c*' show the portion of the display of the user interface 113 in which a graphic content which was previously described with reference to FIGS. 8*b* and 8*c* is shown to the user.

In the current time instant $t_{i+1}$ subsequent to the preceding time instant $t_i$, if the distance value $dU(t_{i+1})$ detected in the current time instant $t_{i+1}$ is smaller than the first distance value $dU(t_i)$+DR, the method 900 again comprises the steps of:

g1) controlling 904', by the electronic control unit 200 for the movement of the physical exercise surface 104 of the treadmill 100, an increase in the feeding speed of the physical exercise surface 104;

h) returning 907, by the electronic control unit 200 for the movement of the physical exercise surface 104 of the treadmill 100, to the step of e) 902' to perform the method 900 starting from the step e) 902' in time instants subsequent to the current time instant $t_{i+1}$.

In greater detail, FIGS. 6*a*' and 8*b*', respectively, show the first distance D1 of the first boundary line E1 of the at least a first control zone Z1 during its modification (displacement) along the development direction DS of the physical exercise surface 104, in the second direction v2 opposite to the first feeding direction v1 of the physical exercise surface 104, while FIGS. 6*b* and 8*c* illustrate, respectively, the first distance D1 of the first boundary line E1 of the at least a first control zone Z1 at the end of its modification (displacement) in which the modified first distance D1 assumes a respective value corresponding to the first reference distance value $dU(t_i)$+DR.

According to a further embodiment, shown by dashed lines in FIG. 10, in combination with that described above, in the current time instant $t_{i+1}$ subsequent to the previous time instant $t_i$, if the distance value $dU(t_{i+1})$ detected in the current time instant $t_{i+1}$ is greater than or equal to the reference distance value $dU(t_i)$+DR, the method 900 comprises the step of returning 908, by the electronic control unit 200 of the physical exercise surface 104 of the treadmill 100, to the step of b) detecting 902 to perform the method 900 starting from the step of b) detecting 902 in time instants subsequent to the current time instant $t_{i+1}$.

Therefore, from this moment on, the subsequent step of c) comparing 903 will compare the value of distance $dU(t_{i+1})$ detected again in the step of b) detecting 902 with the distance value D1 as modified in the last preceding time instant in which it was necessary to change the first distance D1 (step of g2) modifying 905').

It is worth noting that in the embodiments just described, respecting the first minimum distance of reference DR advantageously allows improving the functionality of the treadmill 100 during the execution of the control method because it allows filtering the fluctuations in the detected distance value $dU(t_{i+1})$ and to prevent any movements of the user U associated with the gesture of running itself to be interpreted as the user's willingness not to increase the feeding speed of the physical exercise surface 104 anymore.

In this manner, the electronic control unit 200 effectively and reliably recognizes user's intention to modify or maintain a constant feeding speed of the physical exercise surface 104 ensuring a control and enhanced functionality of the treadmill 100.

According to a further embodiment, shown for example in FIGS. 6*a*, 6*b*, 6*a*', 6*b*', 8*b*, 8*c*, 8*b*' and 8*c*, and by dashed lines in FIG. 9 and in FIG. 10, the step of d2) modifying 905 the first distance D1 of the first boundary line E1 of the at least a first control zone Z1 further comprises a step of modifying 915, by the electronic control unit 200 for the movement of the physical exercise surface 104 of the treadmill 100, also the second distance D1' of the second boundary line E1' of said at least a first control zone Z1 from a first value to a second value, along the development direction DS of the physical exercise surface 104, in the second feeding direction v2 opposite to the first feeding direction v1 of the physical exercise surface 104. The second value is so that the first width A1 of said at least a first control zone Z1 remains unchanged.

According to a further embodiment, again shown for example in FIGS. 6*a*, 6*b*, 6*a*', 6*b*', 8*b*, 8*c*, 8*b*' and 8*c*, and by dashed lines in FIG. 9 and in FIG. 10, the step di g2) modifying 905' the first distance D1 of the first boundary line E1 of the at least a first control zone Z1 further comprises a step of modifying 915', by the electronic control unit 200 for the movement of the physical exercise surface 104 of the treadmill 100, also the second distance D1' of the second boundary line E1' of said at least a first control zone Z1 from a first value to a second value, along the development direction DS of the physical exercise surface 104 in the second feeding direction v2 opposite to the first feeding direction v1 of the physical exercise surface 104. The second value is so that the first width A1 of said at least a first control zone Z1 remains unchanged.

In both embodiments just described, the fact that also the second boundary line E1' of the at least a first control zone Z1 follows the user U allows the user to be able to exit the at least a first control zone Z1, passing through the second boundary line E1', in order to impart additional controls (described below) to the physical exercise surface 104 of the treadmill 100, by traveling less distance with respect to the reference point RF.

According to a further embodiment, in combination with any one of those described above or in combination therewith, illustrated in FIGS. 4, 5, 6*a*, 6*b*, 7*a*, 7*b*, 6*a*', 6*b*', 7*a*', 7*b*' e 8*a*, 8*b*-8*e*, 8*f*, 8*b*'-8*e*', the plurality PZ of control zones, in which the physical exercise surface 104 of the treadmill 100 facing the user U when training on the treadmill 100 is divided by the electronic control unit 200 for the movement of physical exercise surface 104 of the treadmill 100 along the development direction DS of the physical exercise surface 104, also comprises at least a third control zone Z3 having a respective third width A3 along the development direction DS of the physical exercise surface 104.

The third width A3 is comprised between a fifth boundary line E3 and a sixth boundary line E3'.

The fifth boundary line E3 is at a fifth distance D3 from the reference point RF.

The sixth boundary line E3' is a sixth distance D3' from the reference point RF. The sixth distance D3' is greater than the fifth distance D3.

The fifth boundary line E3 of said at least a third control zone Z3 coincides with the second boundary line E1' of said at least a first control zone Z1.

According to this embodiment, as shown by dashed lines in FIG. 9 and in FIG. 10, in a current time instant $t_i$ of a plurality of subsequent time instants $t_1, t_2, \ldots, t_N$, subsequently to the step of b) detecting 902, by the electronic control unit 200 for the movement of the physical exercise surface 104 of the treadmill 100, the distance value $dU(t_i)$ of the portion PU of the user U from the reference point RF, the method 900 further comprises a step of comparing 920, by the electronic control unit 200 for the movement of the physical exercise surface 104 of the treadmill 100, the detected distance value $dU(t_i)$ with the second distance D1' of the second boundary line E1' of the at least a first control zone Z1.

In the current time instant $t_i$ of the plurality of time instants $t_1, t_2, \ldots, t_N$, if the detected distance value $dU(t_i)$ is smaller than the second distance D1' of the second boundary line E1', the method 900, in an embodiment shown by dashed lines in FIG. 9 and in FIG. 10, comprises a step of returning 921', by the electronic control unit 200 of the movement of the physical exercise surface 104 of the treadmill 100, in a step of b) detecting 902 to execute the method 900 starting from the step of b) detecting 902 the current time $t_i$ in subsequent time instants.

Furthermore, in the current time instant $t_i$ of the plurality of time instants $t_1, t_2, \ldots, t_N$, if the detected distance value $dU(t_i)$ is greater than the second distance D1' of the second boundary line E1' (FIGS. 7*a*, 7*b* and 8*d*, 8*e*), the method 900, in an embodiment shown by dashed lines both in FIG. 9 and in FIG. 10, further comprises a step of:

d1) controlling 921, by the electronic control unit 200 of the movement of the physical exercise surface 104 of the treadmill 100, a decrease in the feeding speed of the physical exercise surface 104 (by decreasing the rotation speed of the electric motor 105 with which the feeding speed of the physical exercise surface 104 is correlated).

The fact that, while training on the physical exercise surface 104 of the treadmill 100, the distance value $dU(t_i)$ detected at the first time instant $t_i$ is greater than the second distance D1' of the second boundary line E1' of the at least a first control zone Z1 means that the portion PU of the user U is located in the at least a third control zone Z3.

For this reason, considering that the feeding speed of the physical exercise surface 104 decreases in automatic and adaptive manner in such condition, the at least a third control zone Z3 can also be defined as "deceleration zone" of the physical exercise surface 104.

Furthermore, again in the current time instant $t_i$ of the plurality of time instants $t_1, t_2, \ldots, t_N$, if the detected distance value $dU(t_i)$ is greater than the second distance D1' of the second boundary line E1' (FIGS. 7*a*, 7*b* and 8*d*, 8*e*), the method 900, in an embodiment shown by dashed lines both in FIG. 9 and in FIG. 10, subsequent to the step of (d1') controlling 921, comprises a step of:

d2') modifying 922, by the electronic control unit 200 for the movement of the physical exercise surface 104 of the treadmill 100, the second distance D1' of the second boundary line E1' of the at least a first control zone Z1 from a first value to a second value, along the development direction DS of the physical exercise surface 104, in the first feeding direction v1 of the physical exercise surface 104. The second value is either greater than or equal to the detected distance value $dU(t_i)$.

In an embodiment, shown in FIGS. 9, 7*a*, 7*b*, 8*d*, 8*e*, the step of d2') modifying 922 is performed until the second value of the second distance D1' of the second boundary line E1' of the at least a first control zone Z1 is equal to the distance value $dU(t_i)$ detected in the current time instant $t_i$ ($D1=dU(t_i)$).

Figure 7A:
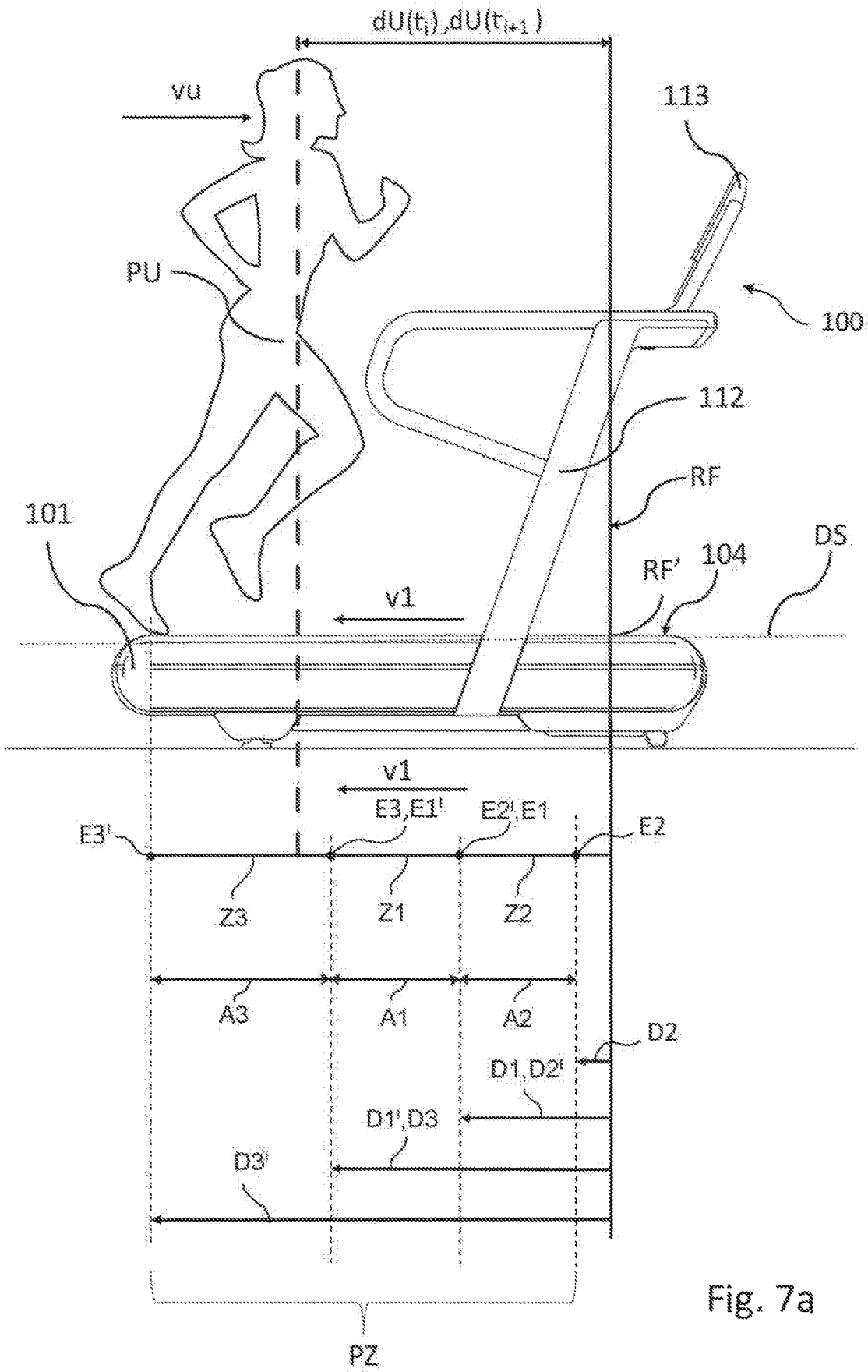
FIGS. 7*a* and 7*b* diagrammatically show a treadmill used by a user in subsequent operating modes during the execution of a step of the adaptive control method of a treadmill according to an embodiment of the present invention.
Figure 7B:
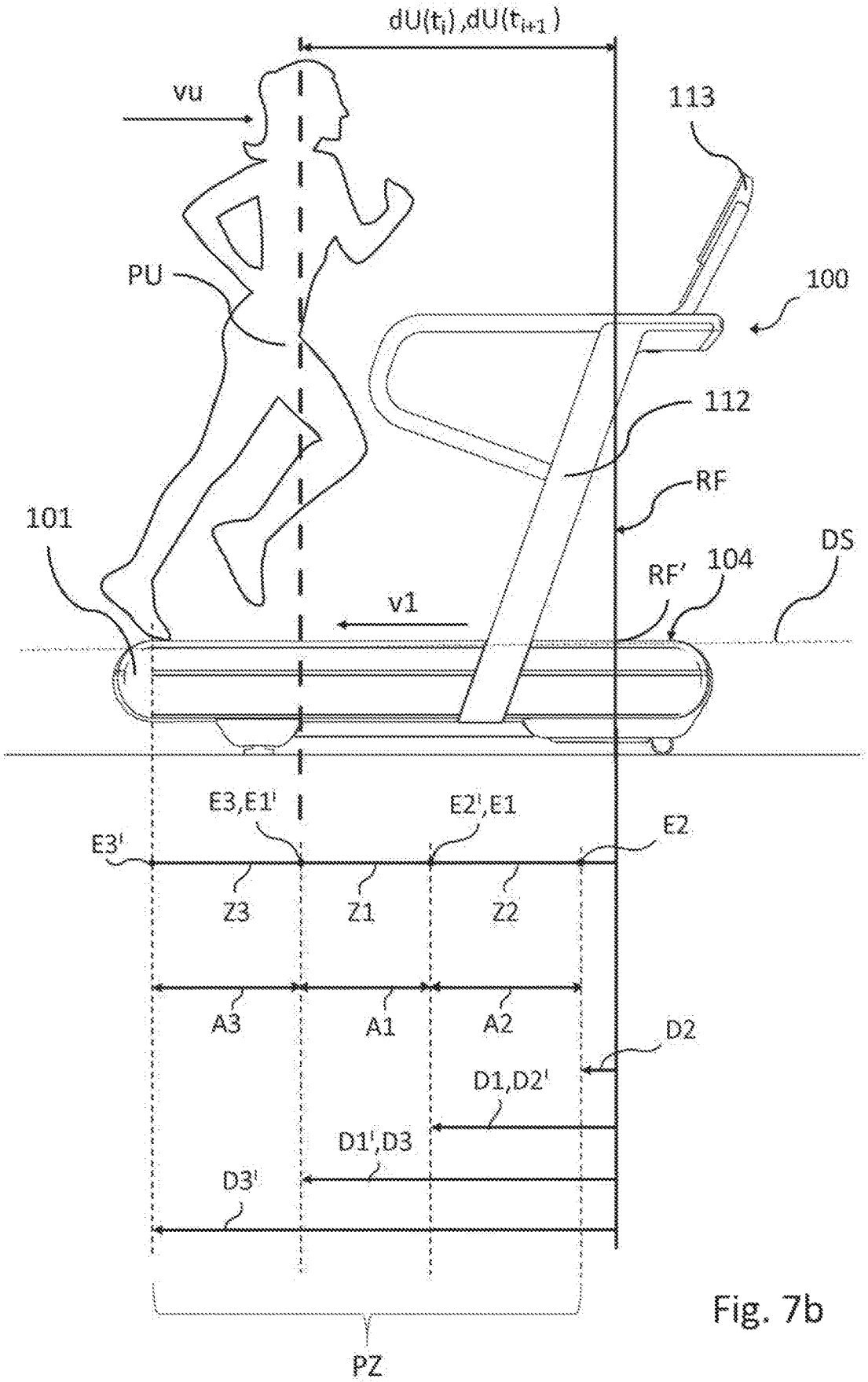
Figure 6A:
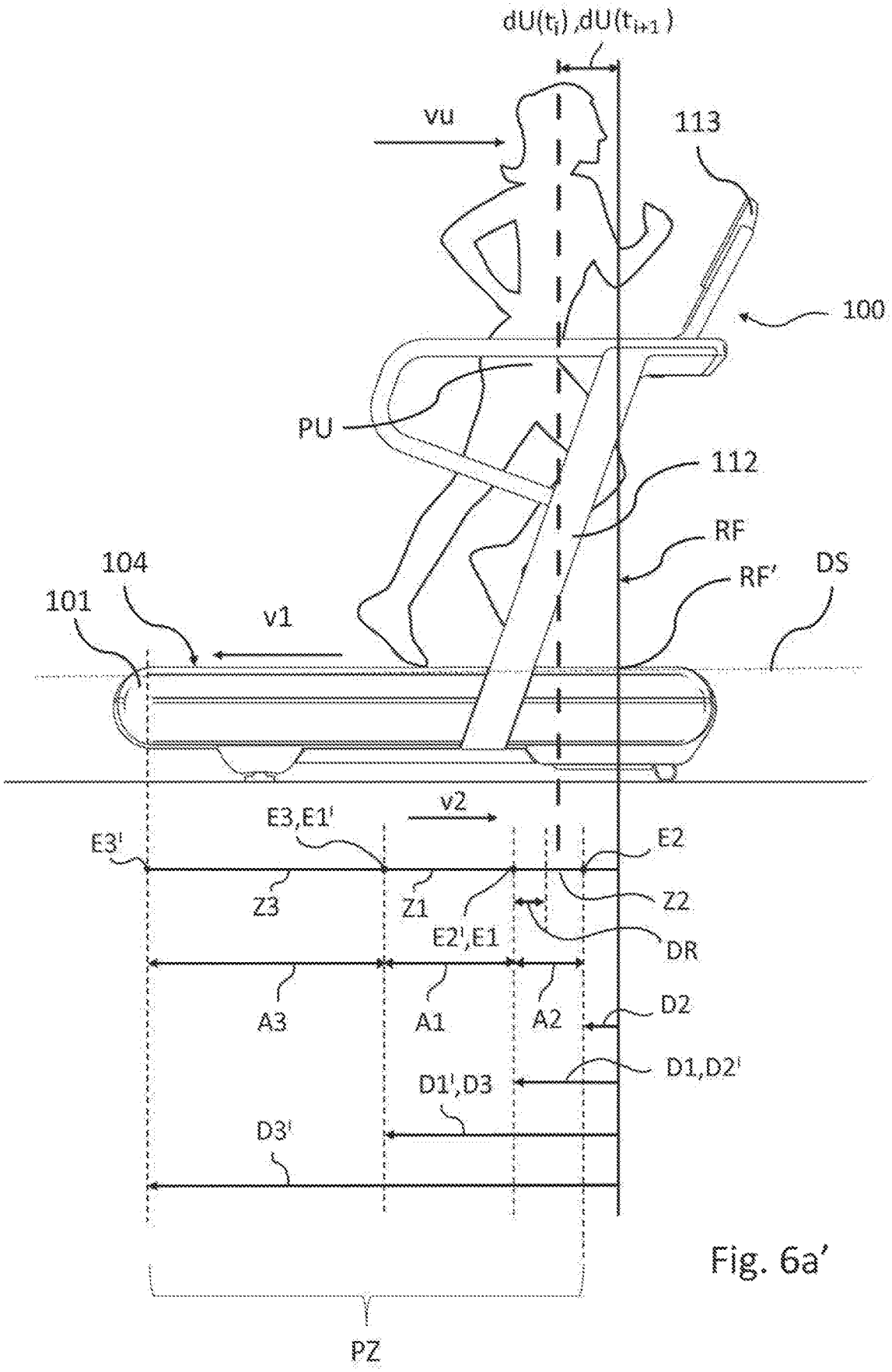
Figure 6B:
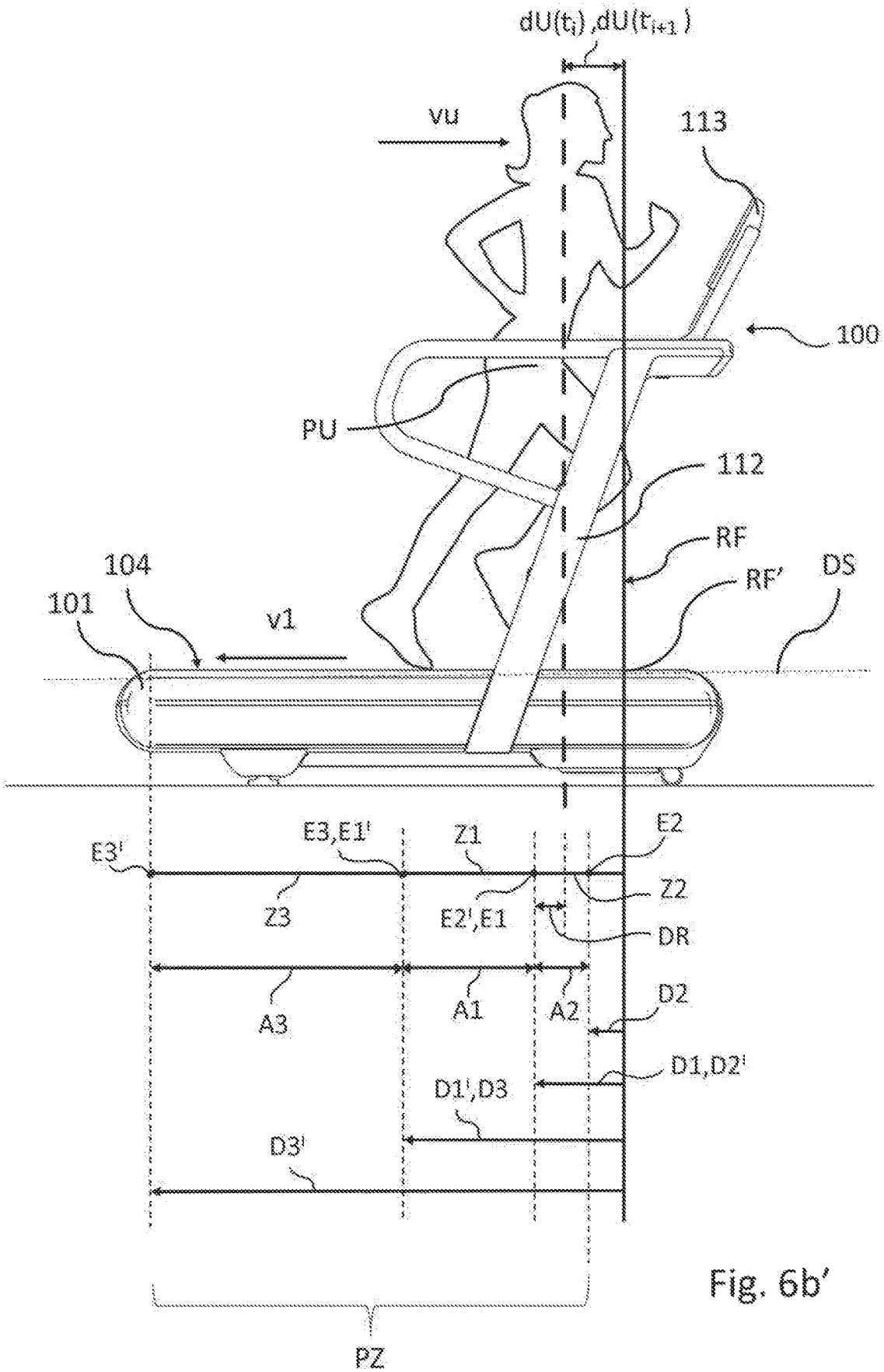
Figure 7A:
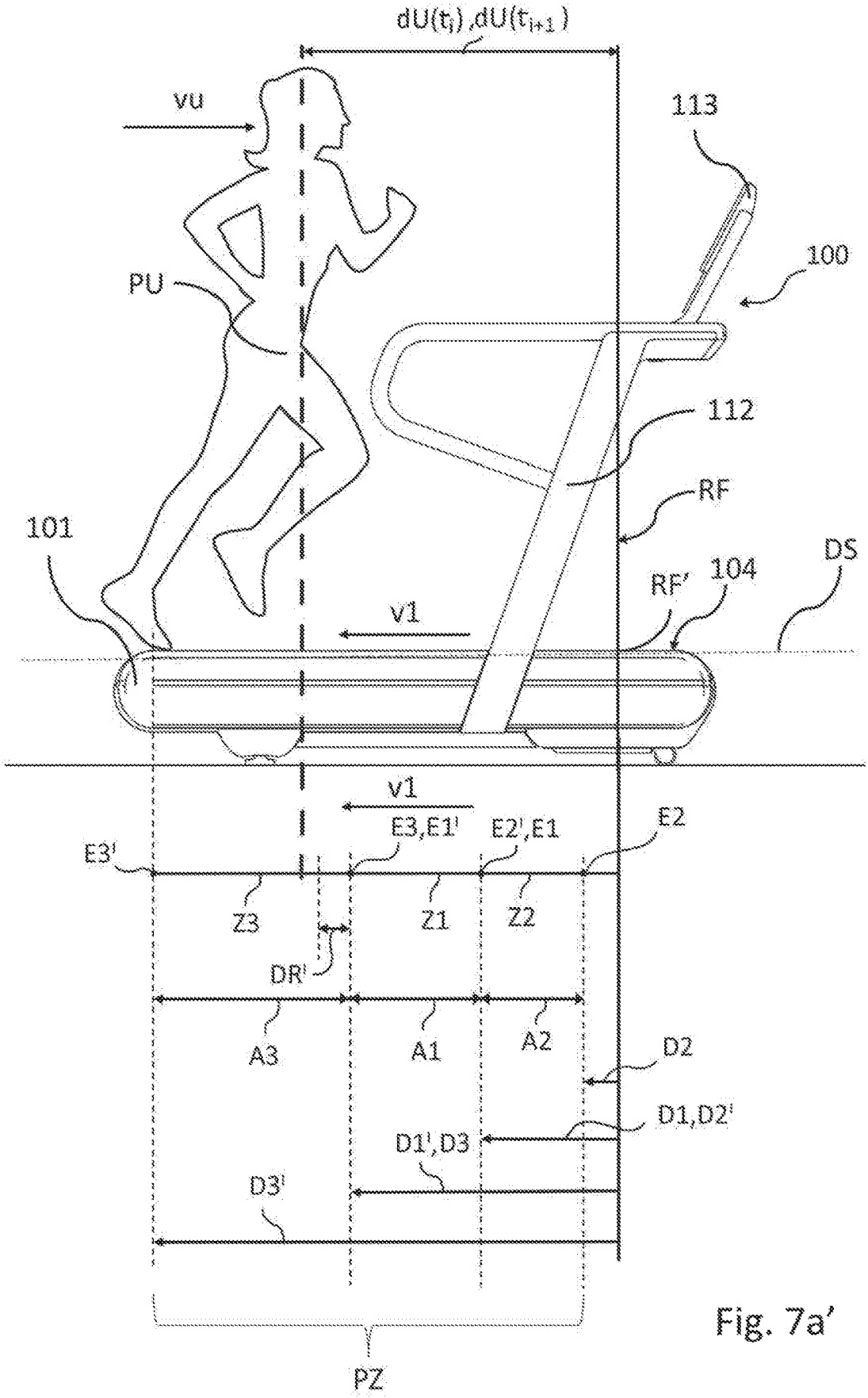
Figure 7B:
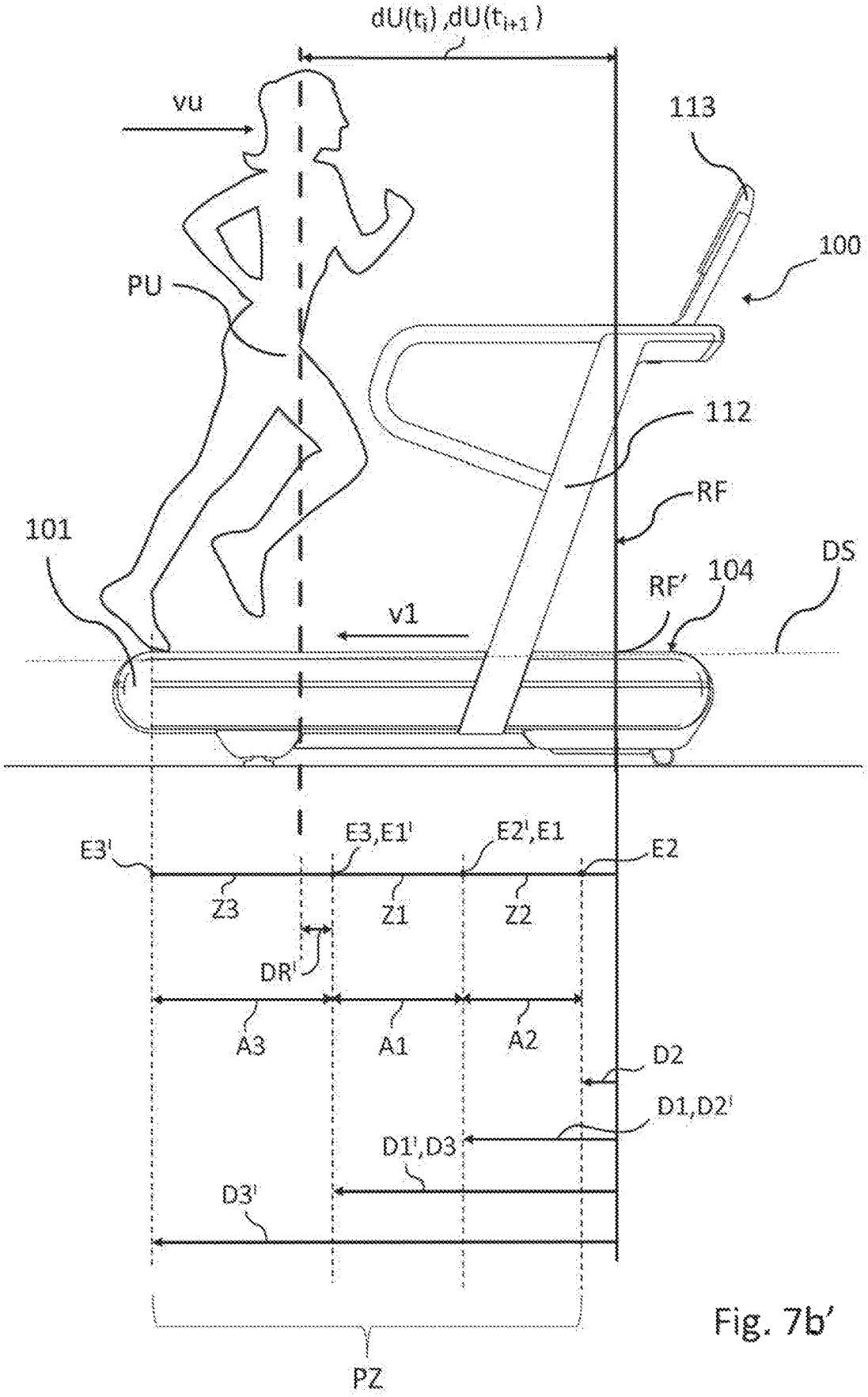
Figure 8D:
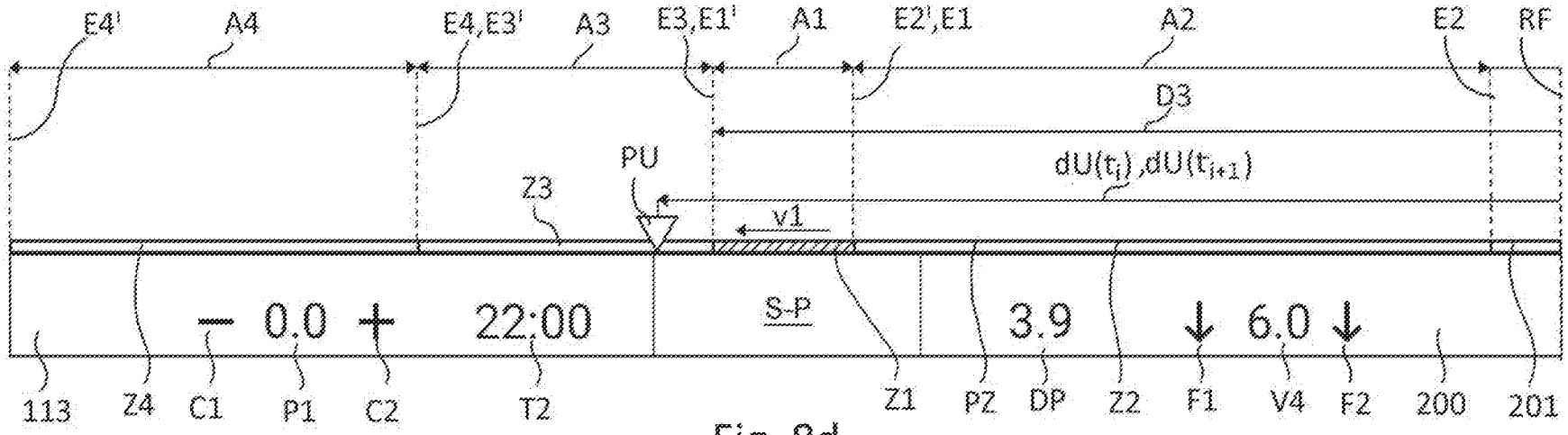
FIGS. 8*d* and 8*e* diagrammatically show a portion of a graphic interface of the treadmill in subsequent operating modes of the adaptive control method of a treadmill according to an embodiment of the present invention.
Figure 8E:
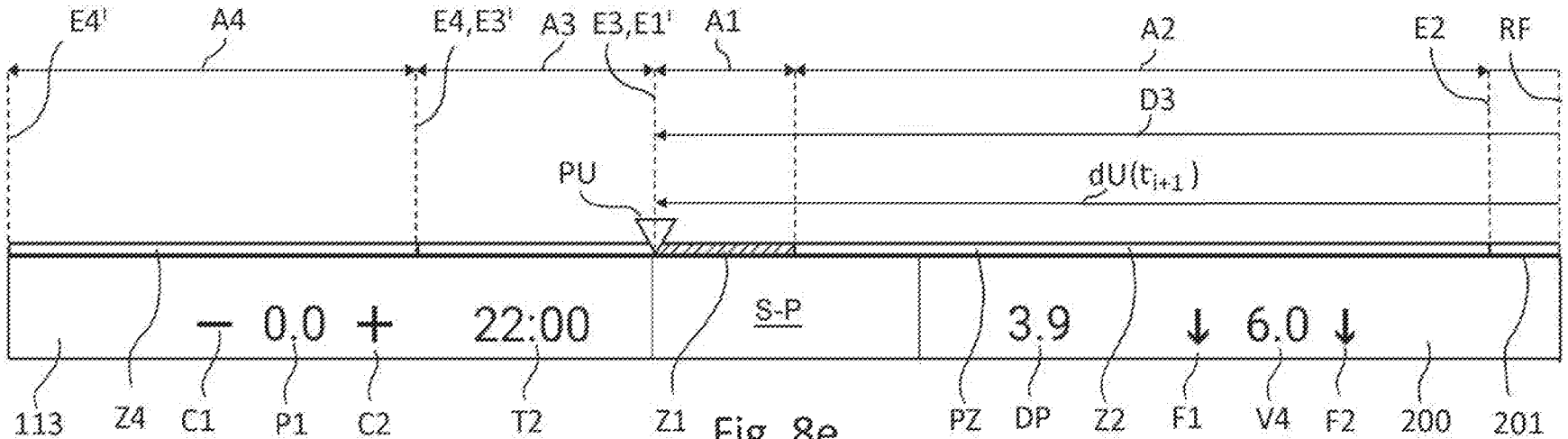

In greater detail, FIGS. 7*a* and 8*d*, respectively show the second distance D1' of the second boundary line E1' of the at least a second control zone Z1 during its modification (displacement) along the development direction DS of the physical exercise surface 104, in the first feeding direction v1 of the physical exercise surface 104, while FIGS. 7*b* and 8*e* illustrate, respectively, the second distance D1' of the second boundary line E1' of the at least a first control zone Z1 at the end of its modification (displacement) in which the modified second distance D1' assumes a respective value equal to the distance value $dU(t_i)$ detected in the current time instant $t_i$.

With particular reference to FIGS. 8*d* and 8*e*, each figure shows a portion of the display of the user interface 113, which shows a graphic content to the user comprising the first graphic bar 200 and the second graphic bar 201.

The first graphic bar 200 comprises, in the example of FIGS. 8*d* and 8*e*, from left to right:

- the first piece of information P1 representing the slope of the treadmill ("0.0", in the example in FIGS. 8*d* and 8*e*);
- the controls C1, C2 of touchscreen type for varying the slope ("+" for increasing the slope and "–" for decreasing the slope, in the example of FIGS. 8*d* and 8*e*);
- the second piece of information T2 representing the time elapsed from the beginning of the training ("22:00" minutes, in the example of FIGS. 8*d* and 8*e*);
- the stop/pause control S-P (e.g. of touchscreen type);
- the third piece of information DP representing the distance traveled from the beginning of the training ("3.9" kilometers in the example in FIGS. 8*d* and 8*e*);
- a fourth piece of information V4 representing the feeding speed of the physical exercise surface 104, correlated with the rotation speed of the electric motor 105 ("6.0" kilometers per hour in the example in FIGS. 8*d* and 8*e*);
- the graphic indications F1, F2 representing the increase or decrease in automatic and adaptive manner of the feeding speed of the physical exercise surface 104, correlated with the rotation speed of the electric motor 105 (in the example in FIGS. 8*d* and 8*e*, these indications are arrows arranged by the sides of the fourth piece of information V4 representing the feeding speed of the physical exercise surface 104; in this step of the method 900, the arrows F1, F2 are directed downwards because they relate to the case in which the feeding speed of the physical exercise surface decreases in automatic and adaptive manner).

The second graphic bar 201, adjacent to the first graphic bar 200 and placed above it, comprises the plurality PZ control zones and a slider PU (in the example of FIGS. 8*d* and 8*e*, represented with a triangle with one vertex pointing downwards) representing the position of the portion PU of the user U on the physical exercise surface 104 with respect to the reference point RF, corresponding to the detected distance value $dU(t_i)$.

In greater detail, in the example in FIGS. 8*d* and 8*e*, from right to left, the second graphic bar 201 comprises:

- the at least a second control zone Z2;
- the at least a first control zone Z1;
- the at least a third control zone Z3 with the slider PU inside;
- the at least a fourth control zone Z4, described below.

In a further embodiment, alternative to the preceding one and shown in FIGS. 10, 7*a*', 7*b*', 8*d*', 8*e*' (described below), the step of d2') modifying 922 is performed until the second value of the second distance D1' of the second boundary line E1' of the at least a first control zone Z1 is equal to a second reference distance value $dU(t_i)-DR'$ corresponding to the distance value $dU(t_i)$ detected in the current time instant $t_i$ to which a value corresponding to a first minimum reference distance DR' is subtracted ($D1'=dU(t_i)-DR'$).

It is worth noting that the second minimum distance of reference DR is represented in FIGS. 7*a*', 7*b*' and 8*d*', 8*e*'.

Turning back to FIG. 9 and FIG. 10, in an embodiment (shown by dashed lines), the method 900, in a current time moment $t_{i+1}$ subsequent to the preceding time instant (ex current time instant) $t_i$, comprises the steps of:

(e') detecting 920', by the electronic control unit 200 for the movement of the physical exercise surface 104 of the treadmill 100, a distance value ($dU(t_{i+1})$) of the portion PU of the user U from the reference point RF;

(f') comparing 923, by the electronic control unit 200 for the movement of the physical exercise surface 104 of the treadmill 100, the distance value $dU(t_{i+1})$ with the distance value $dU(t_i)$ detected in the preceding time instant $t_i$.

It is worth noting that also in this case, the step of b) detecting 920' is performed by using the distance sensor SD operatively connected to the electronic control unit 200.

Again in the current time instant $t_{i+1}$, if the detected distance value $dU(t_{i+1})$ is greater than the distance value $dU(t_i)$ detected in the preceding time instant $t_i$, the method (900) further comprises steps of:

g1') controlling 924, by the electronic control unit 200 for the movement of the physical exercise surface 104 of the treadmill 100, a decrease in the feeding speed of the physical exercise surface 104;

g2') modifying 925, by the electronic control unit 200 for the movement of the physical exercise surface 104 of the treadmill 100, the second distance D1' of the second boundary line E1' of the at least a first control zone Z1 from a first value to a second value, along the development direction DS of the physical exercise surface 104 in the first feeding direction v1. The second value is either lower than or equal to the detected distance value $dU(t_{i+1})$.

It is worth noting that the steps just described are shown again in FIGS. 7*a*, 7*b* and 8*d*, 8*e*, already described above, wherein the distance value $dU(t_{i+1})$ (which is also indicated in the figures above) detected in the current time instant $t_{i+1}$ may be considered instead of the distance value $dU(t_i)$ detected in the preceding time instant $t_i$.

The fact that, while performing the training on the physical exercise surface 104 of the treadmill 100, the distance value $dU(t_{+1})$ detected in the current time instant $t_{i+1}$ is greater than the distance value $dU(t_i)$ detected in the preceding time instant $t_i$ means that the portion PU of the user U is at a greater distance also of the second distance D1' as modified in the preceding time instant $t_i$.

Therefore, the portion PU of the user is still in the at least a third control zone Z3, i.e. in the "deceleration zone".

For this reason, the physical exercise surface 104 is still subject, by the electronic control unit 200, to a decrease of the feeding speed in automatic and adaptive manner.

Furthermore, the fact that, during the training on the physical exercise surface 104 of the treadmill 100, the distance value $dU(t_{+1})$ detected in the current time instant $t_{i+1}$ is greater than the distance value $dU(t_i)$ detected in the preceding time instant $t_i$ involves the modification (displacement), also in the current time instant $t_{i+1}$, of the second distance D1' of the second boundary line E1' of the at least a first control zone Z1 in the first feeding direction v1 so as to follow or reach the detected distance value $dU(t_{i+1})$, advantageously allowing the second boundary line E1' of the at least a first control zone Z1 to follow the portion PU of the user.

In this manner, the method 900 advantageously ensures that the at least a first control zone Z1 ("comfort zone") follows as much as possible the movement of the user U on the physical exercise surface 104 so as to allow the user U him or herself to return from the at least a third control zone Z3 ("deceleration zone") to a detected distance value $dU(t_{i+1})$ such as to fall between the first boundary line E1 and the second boundary line E1' of the at least a first control zone Z1 ("comfort area") by promptly controlling the treadmill 100 in a more precise and safe manner, consequently making the training of the user U safer and more accurate.

It is worth noting that in an embodiment, shown in FIGS. 9, 7*a*, 7*b*, 8*d*, 8*e*, the step of g2') modifying 925' is performed until the second value of the second distance D1' of the second boundary line E1' of the at least a first control zone Z1 is equal to the distance value $dU(t_{i+1})$ detected in the current time instant $t_{i+1}$ ($D1=dU(t_{i+1})$).

In greater detail, also in this case, FIGS. 7*a* and 8*d*, respectively show the second distance D1' of the second boundary line E1' of the at least a first control zone Z1 during its modification (displacement) along the development direction DS of the physical exercise surface 104, in the first feeding direction v1 of the physical exercise surface 104, while FIGS. 7*b* and 8*e* illustrate, respectively, the second distance D1' of the second boundary line E1' of the at least a first control zone Z1 at the end of its modification (displacement) in which the modified second distance D1' assumes a respective value equal to the distance value $dU(t_{i+1})$ detected in the current time instant $t_{i+1}$.

In a further embodiment, alternative to the preceding one and shown in FIGS. 10, 7*a*', 7*b*', 8*d*', 8*e*' (described below), the step of g2') modifying 925 is performed until the second value of the second distance D1' of the second boundary line E1' of the at least a first control zone Z1 is equal to a second reference distance value $dU(t_{i+1})-DR'$ corresponding to the distance value $dU(t_{i+1})$ detected in the current time instant $t_{i+1}$ to which a value corresponding to a second minimum reference distance DR' is subtracted ($D1'=dU(t_{i+1})-DR'$).

Referring again to the last embodiment described, shown in FIG. 9 and in FIG. 10 by dashed line, the method 900, at the current time instant $t_{i+1}$, comprises a step of:

h') returning 926, by the electronic control unit 200 for the movement of the physical exercise surface 104 of the treadmill 100, to the step of e') detecting 920' to execute the method 900 starting from the step of e) detecting 920' in time instants subsequent to the current time instant $t_{i+1}$.

So, according to the method of the present invention, at each time instant of the plurality of time instants $t_1$, $t_2$, . . . , $t_N$ subsequent to the current time instant $t_{i+1}$, the electronic control unit 200 resumes the execution of a step of e') detecting 920' and continues the method by comparing the distance value $dU(t_{i+1})$ detected in the current time instant $t_{i+1}$ with the distance value $dU(t_i)$ detected in the preceding time instant $t_i$ and the second distance D1' as modified in the last preceding time instant in which it was necessary to change the second distance D1' (step of g2') modifying 925).

In an embodiment, shown in FIG. 9 and in FIG. 10 by dashed lines, in combination with the preceding one, in the current time instant $t_{i+1}$ subsequent to the preceding time instant $t_i$, following the step of f') comparing 923, if the distance value $dU(t_{i+1})$ detected in the current time instant $t_{i+1}$ is smaller than the distance value $dU(t_i)$ detected in the preceding time instant $t_i$, the method 900 comprises a step of returning 927, by the electronic control unit 200 for the movement of the physical exercise surface 104 of the treadmill 100, to the step of b) detecting 902 to execute the method 900 starting from the step of b) detecting 902 in time instants subsequent to the current time instant $t_{i+1}$.

It is worth noting that from this moment on, the subsequent step of c) comparing 920 compares the value of distance $dU(t_{+1})$ detected again in the step of b) detecting 902 with the second distance D1' modified in the last preceding time instant in which it was necessary to change the second distance D1' (step of g2') modifying 925).

In an embodiment, also shown in FIG. 9 with dashed lines, in combination with any one of the preceding ones or in combination therewith, in the current time instant $t_{i+1}$ subsequent to the preceding time instant $t_i$, following the step of f') comparing 923, if the distance value $dU(t_{i+1})$ detected in the current time instant $t_{i+1}$ is equal to the distance value $dU(t_i)$ detected in the preceding time instant $t_i$, the method 900 comprises the step of g1') controlling 924, by the electronic control unit 200 of the movement of the physical exercise surface 104 of the treadmill 100, a decrease of the feeding speed of the physical exercise surface 104.

Furthermore, in this embodiment, the method 900 comprises a step of returning 928, by the electronic control unit 200 for the movement of the physical exercise surface 104 of the treadmill 100, to the step of (e') detecting 920' to perform the method 900 starting from the step of (e') detecting 920' in time instants subsequent to the current time instant $t_{i+1}$.

It is worth noting that in this embodiment, in which the user U always maintains the same position with respect to the reference point RF, inside the at least a third control zone Z3, the method 900 includes continuing to increase the feeding speed of the physical exercise surface 104 (step of g1') controlling 924) without further modifying the second distance D1 of the second boundary line E1' of the at least a first control zone Z1.

In an embodiment, in combination with any one of those described above or in combination therewith, in the step of d1') controlling 921 and in the step of g1') controlling 924, the decrease in the feeding speed of the physical exercise surface 104 is a deceleration of the physical exercise surface 104, the value of which is a function of the feeding speed value of the physical exercise surface 104 from which the deceleration starts, i.e. the instantaneous feeding speed value of the physical exercise surface 104 in the current time instant $t_i$ and in the current time instant $t_{i+1}$, respectively, in which the passage occurs from the at least a first control zone Z1 to the at least a third control zone Z3 ($dU(t_i)$ and $dU(t_{i+1})$, respectively, greater than the second distance D1' of the second boundary line E1').

In greater detail, the deceleration value of the physical exercise surface 104 imparted by the electronic control unit 200 is a function of the feeding speed value of the physical exercise surface 104 as follows: the higher is the feeding speed value of the physical exercise surface 104 from which the deceleration starts, the bigger is the imparted deceleration value of the physical exercise surface 104.

In other words, if the feeding speed value of the physical exercise surface 104 from which the deceleration starts is already high, the deceleration value of the physical exercise surface 104 imparted by the electronic control unit 200 will be lower than the case in which the feeding speed of the physical exercise surface 104 from which the deceleration starts is lower.

Therefore, in this embodiment, it is possible to advantageously control the deceleration of the physical exercise surface 104 in the respective "deceleration zone" with a linear law variation with respect to the feeding speed of the physical exercise surface 104 from which the deceleration starts or, in an equivalent manner, by how much the user U passes from at least a first control zone Z1 to the at least a third control zone Z3, passing beyond the second boundary line E1' of the at least a first control zone Z1 (or the fifth boundary line E3 of the at least a third control zone Z3).

According to an embodiment, either in combination with or as an alternative to the preceding one, in step of d1') controlling 921 and in the step of g1') controlling 914, the decrease of the feeding speed of the physical exercise surface 104 is a deceleration, the value of which is directly proportional to the detected value of the distance ($dU(t_i)$ or $dU(t_{i+1})$) of the portion PU of the user U from the reference point RF arranged on the treadmill 100.

In other words, the greater is the distance of the user U from the reference point RF, the greater is the deceleration to which the physical exercise surface 104 is subjected.

Therefore, in this embodiment, it is possible to advantageously control the deceleration of the physical exercise surface 104 in the respective "deceleration zone" in manner linearly dependent with respect to the distance of the user U from the reference point RF (distance sensor SD).

According to an embodiment, shown by dashed lines in FIG. 10 and also shown in FIGS. 7*a*', 7*b*' and 8*d*', 8*e*', in combination with any one of those described above or in combination therewith, in the current time instant $t_{i+1}$ subsequent to the preceding time instant $t_i$, following the step of f) comparing 923, by the electronic control unit 200 for the movement of the physical exercise surface 104 of the treadmill 100, the distance value $dU(t_{i+1})$ with the distance value $dU(t_i)$ detected in the preceding time instant $t_i$, if the distance value $dU(t_{i+1})$ is smaller than the distance value $dU(t_i)$ detected in the preceding time instant $t_h$ the method 900 comprises a step of:

h') comparing 929, by the electronic control unit 200 for the movement of the physical exercise surface 104 of the treadmill 100, the distance value $dU(t_{i+1})$ detected in the current time instant $t_{i+1}$ with a second reference distance value $dU(t_i)-DR'$ corresponding to the distance value $dU(t_i)$ detected in the preceding time instant $t_i$ from which a value corresponding to a second minimum reference distance DR' is subtracted.

It is worth noting that the second minimum distance of reference DR' is represented in FIGS. 7*a*', 7*b*' and 8*d*', 8*e*'.

In this regard, FIGS. 8*d*' and 8*e*' show the portion of the display of the user interface 113 in which a graphic content which was previously described with reference to FIGS. 8*d* and 8*e* is shown to the user.

In the current time instant $t_{i+1}$ subsequent to the preceding time instant $t_h$ if the distance value $dU(t_{i+1})$ detected in the current time instant $t_{i+1}$ is greater than the second distance value $dU(t_i)-DR'$, the method 900 again comprises steps of:

g1') controlling 924', by the electronic control unit 200 for the movement of the physical exercise surface 104 of the treadmill 100, a decrease in the feeding speed of the physical exercise surface 104;

h') returning 926, by the electronic control unit 200 for the movement of the physical exercise surface 104 of the treadmill 100, to the step of e') detecting 920' to execute the method 900 starting from the step of e) detecting 920' in time instants subsequent to the current time instant $t_{i+1}$.

In greater detail, FIGS. 7*a*' and 8*d*' show, respectively, the second distance D1' of the second boundary line E1' of the at least a first control zone Z1 during its modification (displacement) along the development direction DS of the physical exercise surface 104, in the first feeding direction v1 of the physical exercise surface 104, while FIGS. 7*b*' and 8*e*' illustrate, respectively, the second distance D1' of the second boundary line E1' of the at least a first control zone Z1 at the end of its modification (displacement) in which the modified second distance D1 assumes a respective value corresponding to the second reference distance value $dU(t_i)-DR'$.

According to a further embodiment, shown by dashed lines in FIG. 10, in combination with that described above, in the current time instant $t_{i+1}$ subsequent to the preceding time instant $t_i$, if the distance value $dU(t_{i+1})$ detected in the current time instant $t_{i+1}$ is smaller than the second reference distance value $dU(t_i)+DR'$, the method 900 comprises the step of returning 927, by the electronic control unit 200 of the physical exercise surface 104 of the treadmill 100, to the step of b) detecting 902 to execute the method 900 starting from the step of b) detecting 902 in time instants subsequent to the current time instant $t_{i+1}$.

Therefore, from this moment on, the subsequent step of c') comparing 920 will compare the distance value $dU(t_{+1})$ detected again in the step of b) detecting 902 with the second distance D1' from the second boundary line E1' of the at least a first control zone Z1 as modified in the last preceding time instant in which it was necessary to change the second distance D1' (step of g2') of modifying 925).

It is worth noting that in the embodiments just described, respecting the second minimum reference distance DR' advantageously allows improving the functionality of the treadmill 100 during the execution of the control method because it allows filtering the fluctuations in the detected distance value $dU(t_{i+1})$ and preventing any movements of the user U associated with the gesture of running itself to be interpreted as the user's willingness not to decrease the feeding speed of the physical exercise surface 104 anymore.

In this manner, the electronic control unit 200 effectively and reliably recognizes user's intention to modify or maintain a constant feeding speed of the physical exercise surface 104 ensuring a control and enhanced functionality of the treadmill 100.

According to a further embodiment, shown for example in FIGS. 7*a*, 7*b*, 7*a*', 7*b*', 8*d*, 8*e*, 8*d*' and 8*e*, and by dashed lines in FIGS. 9 and 10, the step of d2') modifying 922 the second distance D1' of the second boundary line E1' of the at least a first control zone Z1 further comprises a step of modifying 922', by the electronic control unit 200 for the movement of the physical exercise surface 104 of the treadmill 100, also the first distance of the first boundary line E1 of said at least a first control zone Z1 from a first value to a second value, along the development direction DS of the physical exercise surface 104 in the first feeding direction v1 of the physical exercise surface 104. The second value is so that the first width A1 of said at least a first control zone Z1 remains unchanged.

According to a further embodiment, also shown for example in FIGS. 7*a*, 7*b*, 7*a*', 7*b*', 8*d*, 8*e*, 8*d*' and 8*e*, and with dashed lines in FIGS. 9 and 10, the step of g2') modifying 925 the second distance D1' of the second boundary line E1 of the at least a first control zone Z1 further comprises a step of modifying 925', by the electronic control unit 200 for the movement of the physical exercise surface 104 of the treadmill 100, also the first distance D1 of the first boundary line E1 of said at least a first control zone Z1 from a first value to a second value, along the development direction DS of the physical exercise surface 104 in the first feeding direction v1 of the physical exercise surface 104. The second value is so that the first width A1 of said at least a first control zone Z1 remains unchanged.

In both embodiments just described, the fact that also the first boundary line E1 of the at least a first control zone Z1 follows the user U allows the user to be able to exit the at least a first control zone Z1, passing through the second boundary line E1, in order to impart additional controls to the physical exercise surface 104 of the treadmill 100, entering into the at least a second control zone Z2, by traveling less distance with respect to the reference point RF.

In an embodiment, in combination with any one of those described above or in combination therewith, shown in FIGS. 8*a*, 8*b*-8*e*, 8*f*, 8*b*'-8*e*', the plurality PZ of control zones, in which the physical exercise surface 104 of the treadmill 100 facing the user U when training on the treadmill 100 is divided by the electronic control unit 200 for the movement of physical exercise surface 104 of the treadmill 100 along the development direction DS of the physical exercise surface 104, also comprises at least a fourth control zone Z4 having a respective fourth width A4 along the development direction DS of the physical exercise surface 104.

The fourth width A4 is comprised between a seventh boundary line E4 and an eighth boundary line E4'.

The seventh boundary line E4 is a seventh distance D4 from the reference point RF.

The eighth boundary line E4' is an eighth distance D4' from the reference point RF. The eighth distance D4' is greater than the seventh distance D4.

The seventh boundary line E4 of said at least a fourth control zone Z4 coincides with the sixth boundary line E3' of said at least a third control zone Z3.

According to an embodiment (shown in particular in FIG. 8*f* and by dashed lines in FIGS. 9 and 10), in combination with any one of those described above or in combination therewith, in a current time instant $t_i$ of a plurality of subsequent time instants $t_1, t_2, \ldots, t_N$, subsequently to the step of b) detecting 902, by the electronic control unit 200 for the movement of the physical exercise surface 104 of the treadmill 100, the distance value $dU(t_i)$ of the portion PU of the user U from the reference point RF, the method 900 further comprises a step of comparing 930, by the electronic control unit 200 for the movement of the physical exercise surface 104 of the treadmill 100, the detected distance value $dU(t_i)$ with the seventh distance D4 of the seventh boundary line E4 of the at least a fourth control zone Z4.

In the current time instant $t_i$ of the plurality of time instants $t_1, t_2, \ldots, t_N$, if the detected distance value $dU(t_i)$ is greater than the seventh distance D4 of the seventh boundary line E1' (FIG. 8*f*), the method 900, in an embodiment shown by dashed lines both in FIGS. 9 and 10, further comprises a step of:

controlling 931, by the electronic control unit 200 for the movement of the physical exercise surface 104 of the treadmill 100, a gradual decrease in the feeding speed of the physical exercise surface 104 until it stops.

Figure 8F:
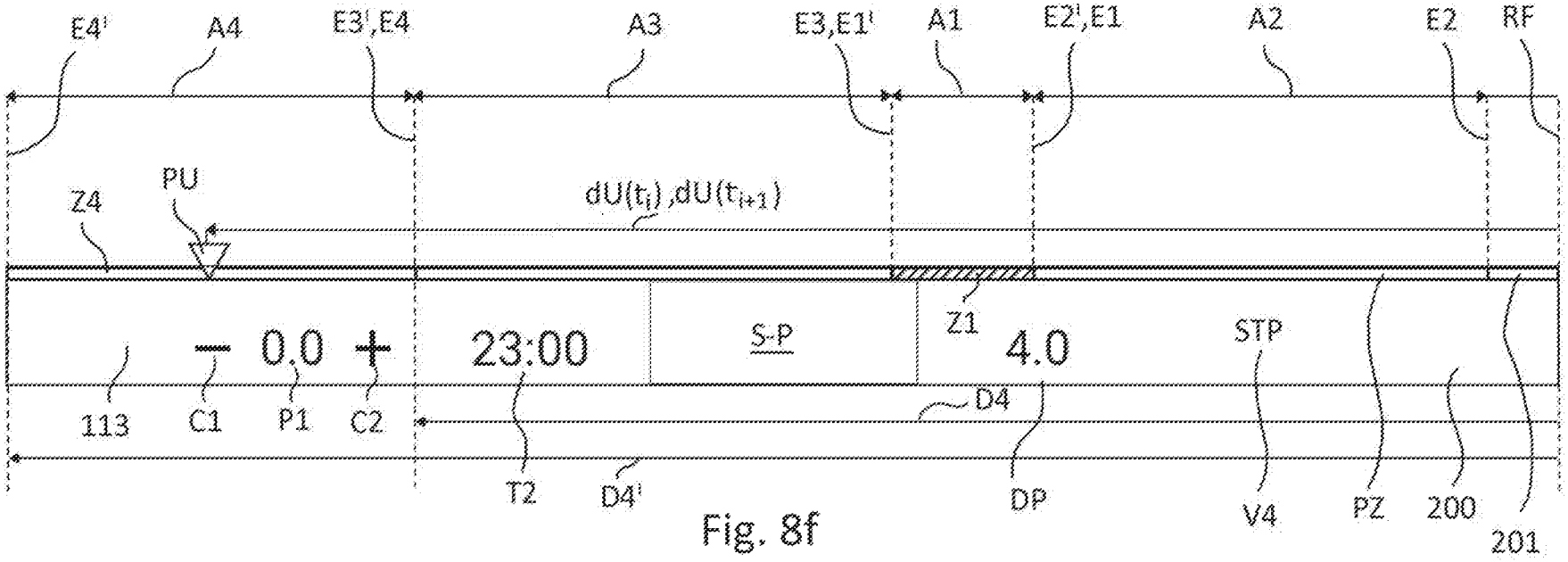
FIG. 8*f* diagrammatically shows a portion of a graphic interface of the treadmill in an operating mode of the adaptive control method of a treadmill according to an embodiment of the present invention.
Figure 8B:
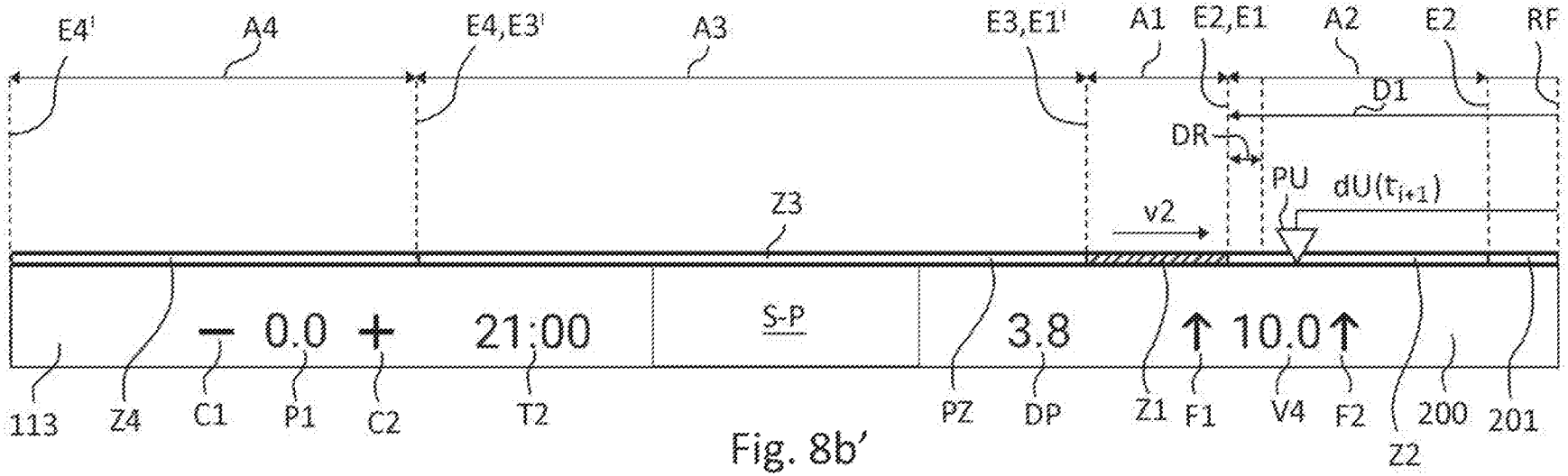
Figure 8C:
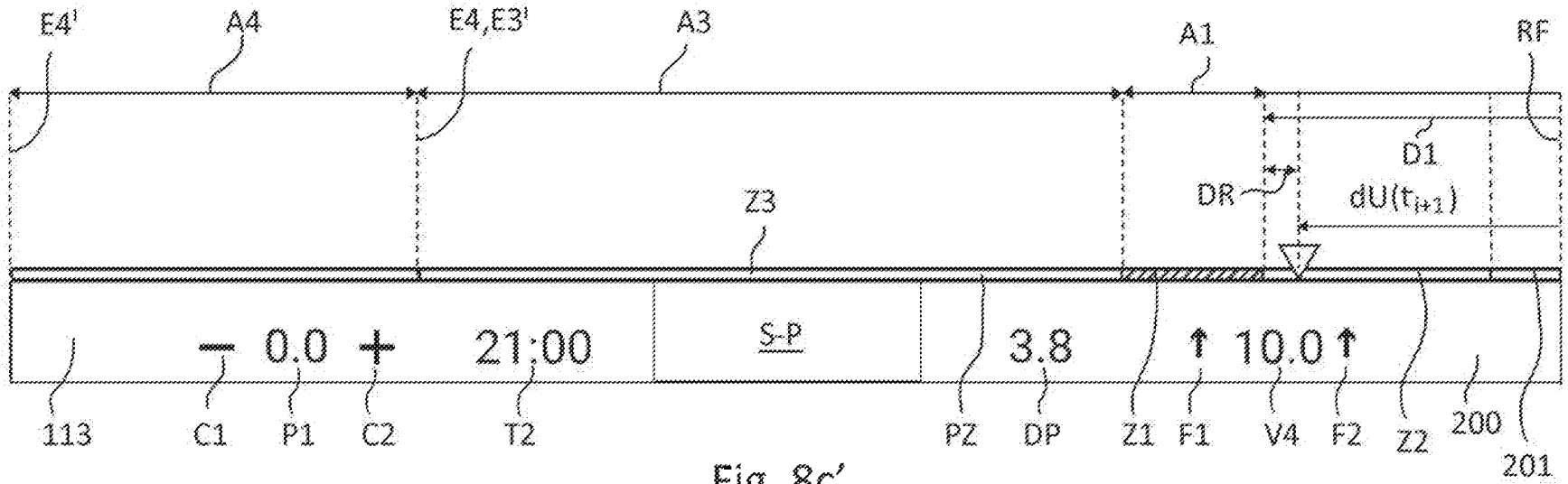
Figure 8D:
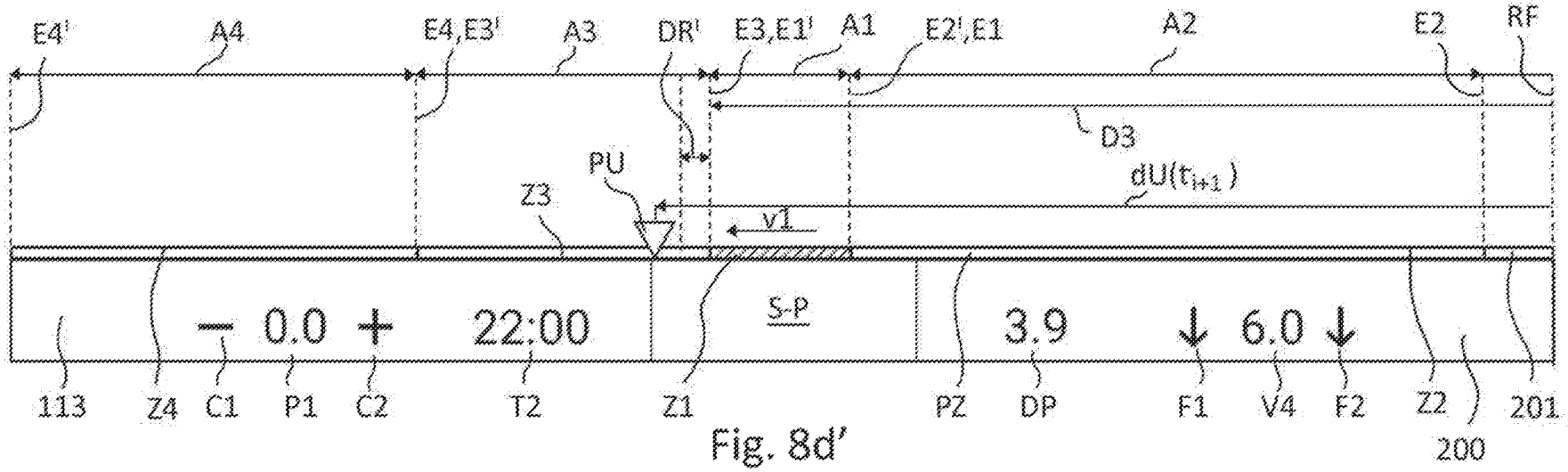
Figure 8E:
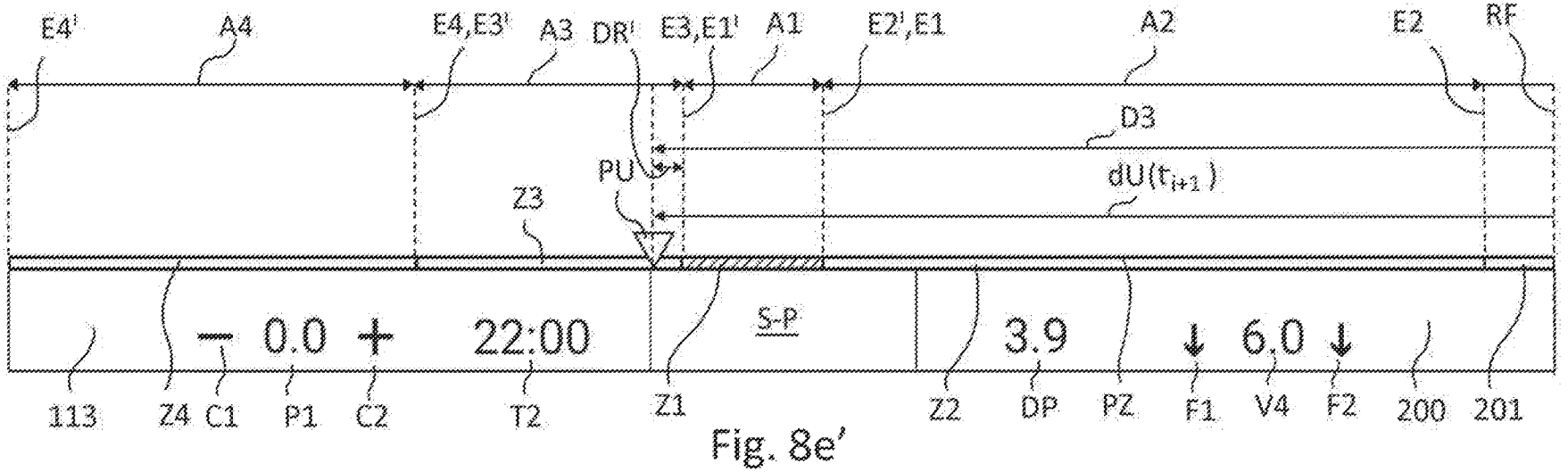

In this regard, FIG. 8*f* shows a portion of the display of the user interface 113, which shows a graphic content to the user comprising the first graphic bar 200 and the second graphic bar 201.

The first graphic bar 200 comprises, in the example of FIG. 8*f*, from left to right:

the first piece of information P1 representing the slope of the treadmill ("0.0", in the example in FIG. 8*f*);

the controls C1, C2 of touchscreen type for varying the slope ("+" for increasing the slope and "−" for decreasing the slope, in the example of FIG. 8*f*);

the second piece of information T2 representing the time elapsed from the beginning of the training ("23:00" minutes, in the example of FIG. 8*f*);

the stop/pause control S-P (e.g. of touchscreen type);

the third piece of information DP representing the distance traveled from the beginning of the training ("4.0" kilometers, in the example in FIG. 8*f*);

the fourth piece of information V4 representing the feeding speed of the physical exercise surface 104, correlated with the rotation speed of the electric motor 105 ("STP" representing the stop in the example in FIG. 8*f*, because in this case the feeding speed of the physical exercise surface 104 decreases gradually to zero);

the graphic indications F1, F2 representing the increase or decrease in automatic and adaptive manner of the feeding speed of the physical exercise surface 104. In the example in FIG. 8*f*, the graphic indications F1, F2 are not displayed because FIG. 8*f* refers to the case in which the feeding speed of the physical exercise surface 104 is stopped.

The second graphic bar 201, adjacent to the first graphic bar 200 and placed above it, comprises the plurality PZ of control zones and a slider PU (in the example of FIGS. 8*f*, represented with a triangle with a vertex pointing downwards) representative of the position of the portion PU of the user U on the physical exercise surface 104 with respect to the reference point RF, corresponding to the detected distance value $dU(t_i)$.

In greater detail, in the example in FIGS. 8*f*, from right to left, the second graphic bar 201 comprises:

the at least a second control zone Z2;

the at least a first control zone Z1;

the at least a third control zone Z3 with the slider PU inside;

the at least a fourth control zone Z4 with the slider PU inside.

The fact that, while training on the physical exercise surface 104 of the treadmill 100, the distance value $dU(t_i)$ detected in the current time instant $t_i$ is greater than the seventh distance D4 of the seventh boundary line E4 of the at least a fourth control zone Z4 means that the portion PU of the user U is located in the at least a fourth control zone Z4.

For this reason, considering that in such condition the stopping of the physical exercise surface 104 occurs, the at least a fourth control zone Z4 can also be defined as "stop zone" of the physical exercise surface 104.

According to a further embodiment (shown in particular in FIG. 5, 8*a* and with dashed lines in FIG. 9 and in FIG. 10), in combination with any one of those described above or in combination therewith, in a current time instant $t_i$ of a plurality of subsequent time instants $t_1, t_2, \ldots, t_N$, subsequently to the step of b) detecting 902, by the electronic control unit 200 for the movement of the physical exercise surface 104 of the treadmill 100, the distance value $dU(t_i)$ of the portion PU of the user U from the reference point RF, the method 900 further comprises a step of checking 932, by the electronic control unit 200 for the movement of the physical exercise surface 104 of the treadmill 100, whether the detected distance value $dU(t_i)$ is or not within a range of values included between the second distance D1' of the second boundary line E1' of the at least a first control zone Z1 and the first distance D1 of the first boundary line E1 of the at least a first control zone Z1.

If, in the current time instant $t_h$ the detected distance value $dU(t_i)$ is within the range of values included between the second distance D1' of the second boundary line E1' of the at least a first control zone Z1 and the first distance D1 of the first boundary line E1' of the at least a first control zone Z1, the method 900 comprises steps of:

keeping unchanged 933, by the electronic control unit 200 for the movement of the physical exercise surface 104, the feeding speed of the physical exercise surface 104;

blocking 934, by the electronic control unit 200 for the movement of the physical exercise surface 104, the first distance D1 of the first boundary line E1 and the second distance D1' of the second boundary line E1' of said at least a first control zone Z1;

returning 935, by the electronic control unit 200 for the movement of the physical exercise surface 104 of the treadmill 100, to the step of b) detecting 902 to perform the method 900 starting from the step of b) detecting 902 in time instants subsequent to the current time instant $t_i$.

With reference to this embodiment, FIG. 8*a* shows a portion of the display of the user interface 113, which shows a graphic content to the user comprising the first graphic bar 200 and the second graphic bar 201.

The first graphic bar 200 comprises, in the example of FIG. 8*a*, from left to right:

the first piece of information P1 representing the slope of the treadmill ("0.0", in the example in FIG. 8*a*);

the controls C1, C2 of touchscreen type for varying the slope ("+" for increasing the slope and "−" for decreasing the slope, in the example of FIG. 8*a*);

the second piece of information T2 representing the time elapsed since the beginning of the training ("20:00" minutes, in the example of FIG. 8*a*);

a stop/pause control S-P (e.g. of touchscreen type);

the third piece of information DP representing the distance traveled from the beginning of the training ("3.7" kilometers, in the example in FIG. 8*a*);

the fourth piece of information V4 representing the feeding speed of the physical exercise surface, correlated with the rotation speed of the electric motor 105 ("8.0" kilometers per hour, in the example in FIGS. 8*a*);

the graphic indications F1, F2 representing the increase or decrease in the training speed, in the example of FIG. 8*a*, are not displayed in that FIG. 8*a* refers to the case in which the feeding speed of the physical exercise surface 104 is kept constant.

The second graphic bar 201, adjacent to the first graphic bar 200 and placed above it, comprises the plurality PZ of control zones and a slider PU (in the example of FIGS. 8*a*, represented by a triangle with a vertex pointing downwards) representing the position of the portion PU of the user U on the physical exercise surface 104 with respect to the reference point RF, corresponding to the detected distance value $dU(t_i)$.

In greater detail, in the example in FIGS. 8*a*, from right to left, the second graphic bar 201 comprises:

the at least a second control zone Z2;

the at least a first control zone Z1 with the slider PU inside;

the at least a third control zone Z3;

the at least a fourth control zone Z4.

Figure 5:
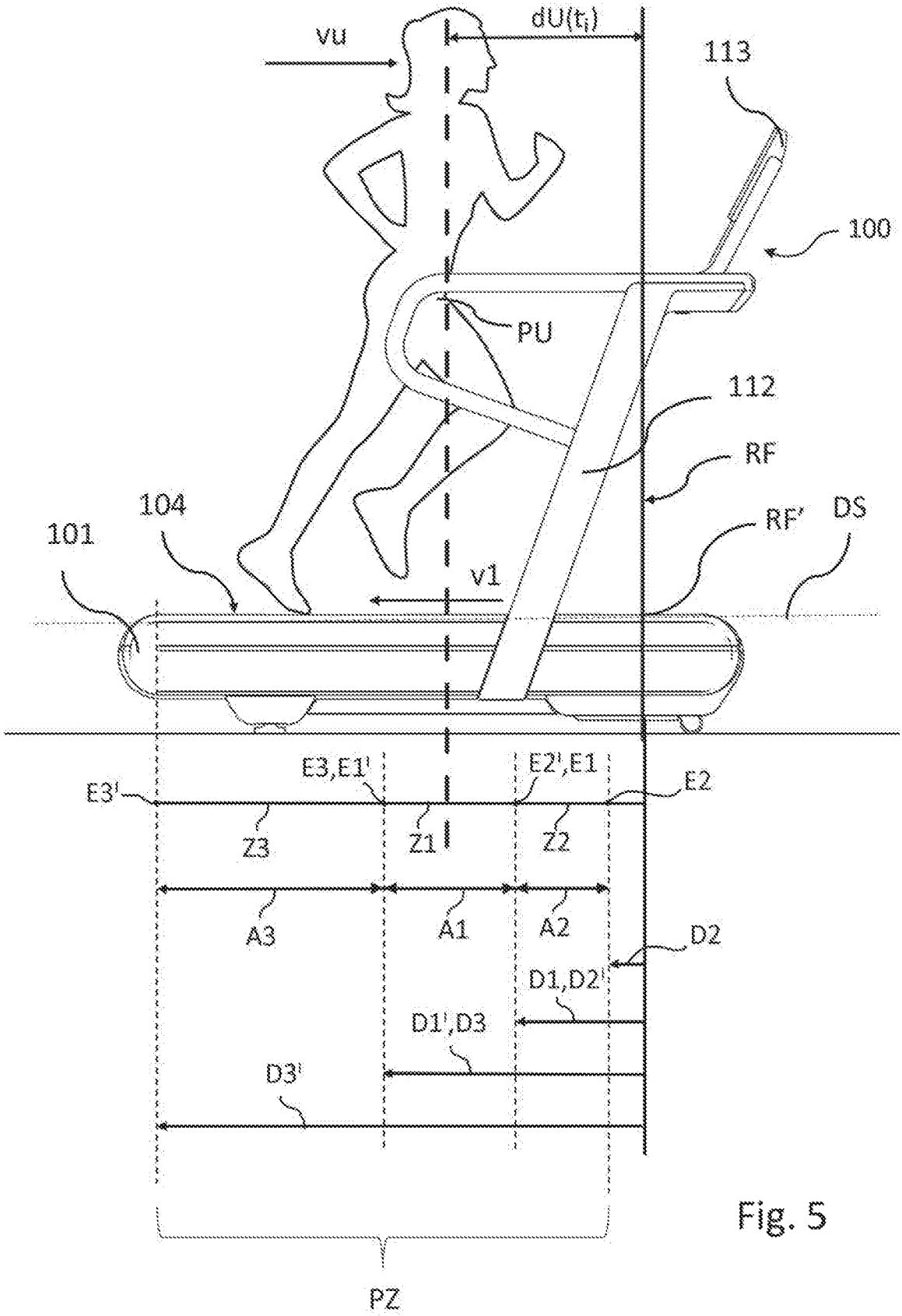
FIG. 5 diagrammatically shows a treadmill used by a user in a operating mode during the execution of a step of the adaptive control method of a treadmill according to an embodiment of the present invention.

The fact that, while training on the physical exercise surface 104 of the treadmill 100, the distance value $dU(t_i)$ detected at the current time instant $t_i$ is comprised between the second distance D1' of the at least one first control zone Z1 and the first distance D1 of the first boundary line E1 of the at least a first control zone Z1 means that the portion PU of the user U is located in the at least a first control zone (FIGS. 5 and 8*a*).

For this reason, considering that in such condition the feeding speed of the physical exercise surface 104 remains unchanged, the at least a first control zone Z1 can also be defined as "comfort zone".

Indeed, inside the "comfort zone", the user U can perform the training while maintaining a training speed as constant as possible, avoiding for example efforts due to acceleration or deceleration of the physical exercise surface 104.

According to another aspect of the present invention, a program product can be loaded in a memory unit (e.g. the memory unit 107 of the electronic control unit 200 of the movement of the physical exercise surface 104 of the treadmill 100) of an electronic computer (e.g. the electronic control unit 200 of the movement of the physical exercise surface 104 of the treadmill 100).

Such product program can be executed by a data processing unit (e.g. the data processing unit 106 of the electronic control unit 200 of the movement of the physical exercise surface 104 of the treadmill 100) of the electronic computer (the electronic control unit 200 of the movement of the physical exercise surface 104 of the treadmill 100) for performing the steps of the method 900 according to any one of the embodiments described previously.

It is worth noting that the scope of the present invention is fully achieved.

Indeed, as mentioned above, the adaptive control method of the treadmill which is the object of the invention advantageously allows a more natural control very similar to outdoor running (without treadmill).

In particular, the control of the treadmill can be obtained in automatic and adaptive manner, and consequently in faster, readier and prompter manner, whereby ensuring greater safety and reliability.

This is due to the fact that the "comfort zone" (the at least a first control zone Z1), with respect to the prior art in which it was a static zone along the development direction of the physical exercise surface, in the method which is the present invention, shifts and adapts in width in automatic and adaptive manner to the position assumed by the user U on the physical exercise surface 104.

The fact that the "comfort zone" (the at least a first control zone Z1) displaces along the development direction DS of the physical exercise surface 104 advantageously allows obtaining a feeding speed of the physical exercise surface 104 at the desired value by the user.

The fact that the "comfort zone" (the at least a first control zone Z1) displaces along the development direction DS of the physical exercise surface 104 allows taking the physical exercise surface 104 to the desired speed in automatic and adaptive manner, therefore with greater precision than the prior art in which, for example in the case of acceleration, it is necessary for the user to retract until returning to the "static comfort zone" so that the feeding speed value of the physical exercise surface stabilizes, but in the meantime, remaining in the "acceleration zone", the feeding speed of the physical exercise surface increases.

A similar advantage is found also in the case of deceleration. The fact that the "comfort zone" follows the user and remains just in front of the user, allows the user to decelerate in a timely manner with respect to the prior art in which there is a so-called "static comfort zone".

Furthermore, according to particular embodiments, the method which is the object of the present invention advantageously allows checking the acceleration or deceleration) of the physical exercise surface in the respective "acceleration zone" (or "deceleration zone") with a linear law variation with respect to the feeding speed of the physical exercise surface 104 from which the acceleration (or deceleration) starts.

Furthermore, in other embodiments, the method which is the object of the invention allows advantageously controlling the acceleration (or deceleration) of the physical exercise surface 104 in the "acceleration zone" (or "deceleration zone") in manner linearly dependent on the distance of the user U from the reference point RF (distance sensor SD).

A person skilled in art will be able to make changes, adaptations and replacements of elements with functionally equivalent ones to the embodiments of the adaptive control method of a treadmill, of the treadmill and of the respective program product described above without departing from the scope of protection of the following claims. All the features described above as belonging to one possible embodiment may be implemented independently from the other embodiments described.

The invention claimed is:

1. An adaptive control method for a treadmill comprising, in a current time instant $t_i$, with $1<i<N$, of a plurality of subsequent time instants $t_1, t_2, \ldots, t_N$, steps of:

a) dividing, by an electronic control unit for movement of a physical exercise surface of the treadmill, the physical exercise surface of the treadmill facing a user when training on the treadmill, into a plurality of control zones of the treadmill as a function of a distance from a reference point on the treadmill, the physical exercise surface having a development direction and a first feeding direction, the plurality of control zones, along the development direction of the physical exercise surface, comprising:

at least a first control zone having a respective first width along the development direction of the physical exercise surface, the first width being between a first boundary line and a second boundary line, the first boundary line being at a first distance from the reference point, the second boundary line being at a second distance from the reference point, the second distance being greater than the first distance, the at least a first control zone being a zone wherein the user maintains a substantially constant training speed;

at least a second control zone having a respective second width along the development direction of the physical exercise surface, the second width being included between a third boundary line and a fourth boundary line, the third boundary line being at a third distance from the reference point, the fourth boundary line being at a fourth distance from the reference point, the fourth distance being greater than the third distance;

the fourth boundary line of said at least a second control zone coinciding with the first boundary line of said at least a first control zone;

b) detecting, by the electronic control unit for the movement of the physical exercise surface of the treadmill, a distance value of the portion of the user from the reference point;

c) comparing, by the electronic control unit for the movement of the physical surface of the treadmill, the detected distance value with the first distance of the first boundary line of the at least a first control zone;

wherein if the detected distance value is smaller than the first distance of the first boundary line of the at least a first control zone, the method further comprises steps of:

d1) controlling, by the electronic control unit for the movement of the physical exercise surface of the treadmill, an increase in feeding speed of the physical exercise surface;

d2) modifying, by the electronic control unit for the movement of the physical exercise surface of the treadmill, the first distance of the first boundary line of the at least a first control zone from a first value to a second value, along the development direction of the physical exercise surface in a second feeding direction opposite to the first feeding direction, the second value being either greater than or equal to the detected distance value.

2. The method according to claim 1, wherein, in a current time instant $t_{i+1}$ subsequent to the previous time instant $t_i$, the method comprises steps of:

e) detecting, by the electronic control unit for the movement of the physical exercise surface of the treadmill, a second distance value of the portion of the user from the reference point;

f) comparing, by the electronic control unit for the movement of the physical exercise surface of the treadmill, the detected second distance value with the distance value detected in the previous time instant t;

wherein if the second distance value detected in the current time instant $t_{i+1}$ is smaller than the distance value detected in the previous time instant $t_i$, the method further comprises steps of:

g1) controlling, by the electronic control unit for the movement of the physical exercise surface of the treadmill, an increase in the feeding speed of the physical exercise surface;

g2) modifying, by the electronic control unit for the movement of the physical exercise surface of the treadmill, the first distance of the first boundary line of the at least a first control zone from a third value to a fourth value, along the development direction of the physical exercise surface, in the second feeding direction opposite to the first feeding direction, the second value being either greater than or equal to the detected distance value;

h) returning, by the electronic control unit for the movement of the physical exercise surface of the treadmill, to the step of e) detecting to perform the method starting from the step of e) detecting in time instants subsequent to the current time instant $t_{i+1}$.

3. The method according to claim 2, wherein, in the current time instant $t_{i+1}$ subsequent to the previous time instant $t_i$, following the step of f) comparing, by the electronic control unit for the movement of the physical exercise surface of the treadmill, the second distance value with the distance value detected in the previous time instant $t_i$, if the distance value is greater than the distance value detected in the previous time instant $t_i$, the method comprises a step of:

comparing, by the electronic control unit for the movement of the physical exercise surface of the treadmill, the distance value detected in the current time instant $t_{i+1}$ with a first reference distance value corresponding to the second distance value detected in the previous time instant $t_i$ to which a value corresponding to a first minimum reference distance is added;

in the current time instant $t_{i+1}$ subsequent to the previous time instant $t_i$, if the second distance value detected in the current time instant $t_{i+1}$ is smaller than the first distance value, the method comprises steps of:

g1) controlling, by the electronic control unit for the movement of the physical exercise surface of the treadmill, an increase in the feeding speed of the physical exercise surface;

h) returning, by the electronic control unit for the movement of the physical exercise surface of the treadmill, to the step of e) detecting to perform the method starting from the step of e) detecting in time instants subsequent to the current time instant $t_{i+1}$.

4. The method according to claim 3, wherein, in the current time instant $t_{i+1}$ subsequent to the previous time instant $t_i$, if the second distance value detected in the current time instant $t_{i+1}$ is greater than the reference distance value, the method comprises a step of returning, by the electronic control unit of the physical exercise surface of the treadmill, to the step of b) detecting to perform the method starting from the step of b) detecting in time instants subsequent to the current time instant $t_{i+1}$.

5. The method according to claim 1, wherein the plurality of control zones, in which the physical exercise surface of the treadmill facing the user when training on the treadmill is divided by the electronic control unit for the movement of physical exercise surface of the treadmill, along the development direction of physical exercise surface, also comprises at least a third control zone having a respective third width along the development direction of the physical exercise surface, the third width being included between a fifth boundary line and a sixth boundary line, the fifth boundary line being at a fifth distance from the reference point, the sixth boundary line being at a sixth distance from the reference point, the sixth distance being greater than the fifth distance, the fifth boundary line of said at least a third control zone coinciding with the second boundary line of said at least a first control zone;

in the current time instant $t_i$ of a plurality of subsequent time instants $t_1, t_2, \ldots, t_N$, subsequently to the step of b) detecting, by the electronic control unit for the movement of the physical exercise surface of the treadmill, the distance value of the portion of the user from the reference point, the method comprising a step of:

c') comparing, by the electronic control unit for the movement of the physical exercise surface of the treadmill, the detected distance value with the second distance of the first boundary line of the at least a first control zone;

wherein if the detected distance value is greater than the second distance of the second boundary line, the method further comprises steps of:

d1') controlling, by the electronic control unit for the movement of the physical exercise surface of the treadmill, a decrease in the feeding speed of the physical exercise surface;

d2') modifying, by the electronic control unit for the movement of the physical exercise surface of the treadmill, the second distance of the second boundary line of the at least a first control zone from a first value to a second value, along the development direction of the physical exercise surface, in the first feeding direction of the physical exercise surface, the second value being either greater than or equal to the detected distance value.

6. The method according to claim 5, wherein, in a current time instant $t_{i+1}$ subsequent to the previous time instant $t_i$, the method comprises steps of:

e') detecting, by the electronic control unit for the movement of the physical exercise surface of the treadmill, a second distance value of the portion of the user from the reference point;

f) comparing, by the electronic control unit for the movement of the physical exercise surface of the treadmill, the detected second distance value with the distance value detected in the previous time instant t;

wherein if the detected distance value is greater than the distance value detected in the previous time instant $t_i$, the method further comprises steps of:

g1') controlling, by the electronic control unit for the movement of the physical exercise surface of the treadmill, a decrease in the feeding speed of the physical exercise surface;

g2') modifying, by the electronic control unit for the movement of the physical exercise surface of the treadmill, the second distance of the second boundary line of the at least a first control zone a first value to a second value, along the development direction of the physical exercise surface in the first feeding direction, the second value being either greater than or equal to the detected second distance value;

h') returning, by the electronic control unit for the movement of the physical exercise surface of the treadmill, to the step of e') detecting to perform the method starting from the step of e') detecting in time instants subsequent to the current time instant $t_{i+1}$.

7. The method according to claim 6, wherein, in the current time instant $t_{i+1}$ subsequent to the previous time instant $t_i$, following the step of f) comparing, by the electronic control unit for the movement of the physical exercise surface of the treadmill, the second distance value with the distance value detected in the previous time instant $t_i$, if the second distance value is smaller than the distance value detected in the previous time instant $t_i$, the method comprises a step of:

h') comparing, by the electronic control unit for the movement of the physical exercise surface of the treadmill, the second distance value detected in the current time instant $t_{i+1}$ with a second reference distance value corresponding to the distance value detected in the previous time instant $t_i$ from which a value corresponding to a second minimum reference distance is subtracted;

wherein in the current time instant $t_{i+1}$ subsequent to the previous time instant $t_i$, if the second distance value detected in the current time instant $t_{i+1}$ is greater than the second reference distance value, the method comprises steps of:

g1') controlling, by the electronic control unit for the movement of the physical exercise surface of the treadmill, a decrease in the feeding speed of the physical exercise surface;

h') returning, by the electronic control unit for the movement of the physical exercise surface of the treadmill, to the step of e') detecting to perform the method starting from the step of e') detecting in time instants subsequent to the current time instant $t_{i+1}$.

8. The method according to claim 7, wherein, in the current time instant $t_{i+1}$ subsequent to the time instant $t_i$, if the second distance value detected in the current time instant $t_{i+1}$ is smaller than the second reference distance value, the method comprises the step of returning, by the electronic control unit of the physical exercise surface of the treadmill, to the step of b) detecting to perform the method starting from the step of b) detecting in time instants subsequent to the current time $t_{i+1}$.

9. The method according to claim 5, wherein the plurality of control zones in which the physical exercise surface of the treadmill facing the user when training on the treadmill is divided by the electronic control unit for the movement of physical exercise surface comprises at least a fourth control zone having a respective fourth width along the development direction of the physical exercise surface, the fourth width being included between a seventh boundary line and an eighth boundary line, the seventh boundary line being at a seventh distance from the reference point, the eighth boundary line being at an eighth distance from the reference point, the eighth distance being greater than the seventh distance, the seventh boundary line of said at least a fourth control zone coinciding with the sixth boundary line of said at least a third control zone;

in the current time instant $t_i$ of a plurality of subsequent time instants $t_1, t_2, \ldots, t_N$, subsequent to the step of b) detecting, by the electronic control unit for the movement of the physical exercise surface of the treadmill, the distance value of the portion of the user from the reference point, the method further comprises a step of comparing, by the electronic control unit for the movement of the physical exercise surface of the treadmill, the detected distance value with the seventh distance of the seventh boundary line of the at least a fourth control zone, wherein if the detected distance value is greater than the seventh distance of the seventh boundary line, the method further comprises a step of:

controlling, by the electronic control unit for the movement of the physical exercise surface of the treadmill, a gradual decrease in the feeding speed of the physical exercise surface until the physical exercise surface stops.

10. The method according to claim 1, wherein, in the current time instant $t_i$ of a plurality of subsequent time instants $t_1, t_2, \ldots, t_N$, subsequently to the step of b) detecting, by the electronic control unit for the movement of the physical exercise surface of the treadmill, the distance value of the portion of the user from the reference point, the method further comprises a step of checking, by the electronic control unit for the movement of the physical exercise surface of the treadmill, whether the detected distance value is or not within a range of values included between the second distance of the second boundary line of the at least a first control zone and the first distance of the first boundary line of the at least a first control zone.

11. The method according to claim 10, wherein, if, in the current time instant $t_i$, the detected distance value is within the range of values included between the second distance of the second boundary line of the at least a first control zone and the first distance of the first boundary line of the at least a first control zone, the method comprises steps of:

keeping unchanged, by the electronic control unit for the movement of the physical exercise surface of the treadmill, the feeding speed of the physical exercise surface;

blocking, by the electronic control unit for the movement of the physical exercise surface, the first distance of the first boundary line and the second distance of the second boundary line of said at least a first control zone;

returning, by the electronic control unit for the movement of the physical exercise surface of the treadmill, to the step of b) detecting to perform the method starting from the step of b) detecting in time instants subsequent to the current time instant $t_{i+1}$.

12. The method according to claim 2, wherein the step of g2) modifying is performed until the second value of the first distance of the first boundary line of the at least a first control zone is equal to a first reference distance value corresponding to the second distance value detected in the current time instant $t_{i+1}$ to which a value corresponding to a first minimum reference distance is added.

13. The method according to claim 2, wherein, in the current time instant $t_{i+1}$ subsequent to the previous time instant $t_i$, following the step of f) comparing, if the second distance value detected in the current time instant $t_{i+1}$ is greater than the distance value detected in the previous time instant the method comprises a step of returning, by the electronic control unit for the movement of the physical exercise surface of the treadmill, to the step of b) detecting to perform the method starting from the step of b) detecting in time instants subsequent to the current time instant $t_{i+1}$.

14. The method according to claim 2, wherein, in the current time instant $t_{i+1}$ subsequent to the previous time instant $t_i$, following the step of f) comparing, if the second distance value detected in the current time instant $t_{i+1}$ is equal to the distance value detected in the previous time instant $t_i$, the method comprises the steps of:

g1) controlling, by the electronic control unit for the movement of the physical exercise surface of the treadmill, an increase in the feeding speed of the physical exercise surface;

returning, by the electronic control unit for the movement of the physical exercise surface of the treadmill, to the step of e) detecting to perform the method starting from the step of e) detecting in time instants subsequent to the current time instant $t_{i+1}$.

15. The method according to claim 2, wherein in the step of d1) controlling and in the step of g1) controlling, the increase in the feeding speed of the physical exercise surface is an acceleration of the physical exercise surface, the value of which is a function of the feeding speed value of the physical exercise surface from which the acceleration starts, or the instantaneous speed value of the physical exercise surface in the current time instant $t_i$ and in the current time instant $t_{i+1}$, respectively, in which the passage occurs from the at least a first control zone to the at least a second control zone.

16. The method according to claim 2, wherein:

the step of d2) modifying the first distance of the first boundary line of the at least a first control zone further comprises a step of modifying, by the electronic control unit for the movement of the physical exercise surface of the treadmill, also the second distance of the second boundary line of said at least a first control zone value to a fifth value, along the development direction of the physical exercise surface, in the second feeding direction opposite to the first feeding direction of the physical exercise surface, the fifth value maintaining the first width of said at least a first control zone;

the step of g2) modifying the first distance of the first boundary line of the at least a first control zone further comprises a step of modifying, by the electronic control unit for the movement of the physical exercise surface of the treadmill, also the second distance of the second boundary line of said at least a first control zone a first value to a sixth value, along the development direction of the physical exercise surface in the second feeding direction opposite to the first feeding direction of the physical exercise surface, the sixth value maintaining the first width of said at least a first control zone unchanged.

17. The method according to claim 5, wherein the step of d2') modifying is performed until the second value of the second distance of the second boundary line of the at least a first control zone is equal to the distance value detected in the current time instant $t_i$.

18. The method according to claim 6, wherein the step of g2') modifying is performed until the second value of the second distance of the second boundary line of the at least a first control zone is equal to a second reference distance value corresponding to the second distance value detected in the current time instant $t_{i+1}$ from which a value corresponding to a second minimum reference distance is subtracted.

19. The method according to claim 6, wherein, in the current time instant $t_{i+1}$ subsequent to the previous time instant $t_i$, following the step of f) comparing, if the second distance value detected in the current time instant $t_{i+1}$ is smaller than the distance value detected in the previous time instant $t_i$, the method comprises a step of returning, by the electronic control unit of the physical exercise surface of the treadmill, to the step of b) detecting to perform the method starting from the step of b) detecting in time instants subsequent to the current time instant $t_{i+1}$.

20. The method according to claim 6, wherein, in the current time instant $t_{i+1}$ subsequent to the previous time instant $t_i$, following the step of f) comparing, if the second distance value detected in the current time instant $t_{i+1}$ is equal to the distance value detected in the previous time instant $t_i$, the method comprises steps of:

g1') controlling, by the electronic control unit for the movement of the physical exercise surface of the treadmill, a decrease in the feeding speed of the physical exercise surface;

returning, by the electronic control unit for the movement of the physical exercise surface of the treadmill, to the step of (e') detecting to perform the method starting from the step of (e') detecting in time instants subsequent to the current time instant $t_{i+1}$.

21. The method according to claim 6, wherein in the step of d1') controlling and in the step of g1') controlling, the decrease in the feeding speed of the physical exercise surface is a deceleration of the physical exercise surface, the value of which is a function of the feeding speed value of the physical exercise surface from which the deceleration starts, or the instantaneous feeding speed value of the physical exercise surface in the current time instant $t_i$ and in the current time instant $t_{i+1}$, respectively, in which the passage occurs from the at least a first control zone to the at least a third control zone.

22. The method according to claim 6, wherein:

the step of d2') modifying the second distance of the second boundary line of the at least a first control zone further comprises a step of modifying, by the electronic control unit for the movement of the physical exercise surface of the treadmill, also the first distance of the first boundary line of said at least a first control zone from a third value to a fourth value, along the development direction of the physical exercise surface in the first feeding direction of the physical exercise surface, the second value maintaining the first width of said at least a first control zone unchanged;

the step of g2') modifying the second distance of the second boundary line of the at least a first control zone further comprises a step of modifying, by the electronic control unit for the movement of the physical exercise surface of the treadmill, also the first distance of the first boundary line of said at least a first control zone from a first value to a second value, along the development direction of the physical exercise surface in the first feeding direction of the physical exercise surface, the second value maintaining the first width of said at least a first control zone unchanged.

23. The method according to claim 1, wherein the step of modifying is performed until the second value of the first distance of the first boundary line of the at least a first control zone is equal to a first reference distance value corresponding to the distance value detected in the current time instant $t_i$ to which a value corresponding to a first minimum reference distance is added.

24. A treadmill comprising:

a physical exercise surface for training of a user on the treadmill, the physical exercise surface having a development direction and a first feeding direction parallel to the development direction of the physical exercise surface;

an electronic control unit for movement of the physical exercise surface of the treadmill;

a distance sensor operatively connected to the electronic control unit-for the movement of the physical exercise surface of the treadmill, the distance sensor being configured to detect a distance value of a portion of the user from a reference point on the treadmill during the training of the user on the physical exercise surface, the electronic control unit for the movement of the physical exercise surface of the treadmill, in a current time instant $t_i$, with $1<i<N$, of a plurality of subsequent time instants $t_1, t_2, \ldots, t_N$, being configured to:

a) divide the physical exercise surface of the treadmill facing the user when training on the treadmill, into a plurality of control zones of the treadmill as a function of a distance from the reference point on the treadmill, the plurality of control zones, along the development direction of the physical exercise surface, comprising:

at least a first control zone having a respective first width along the development direction of the physical exercise surface, the first width being between a first boundary line and a second boundary line, the first boundary line being at a first distance from the reference point, the second boundary line being at a second distance from the reference point, the second distance being greater than the first distance, the at least a first control zone being a zone wherein the user maintains a substantially constant training speed;

at least a second control zone having a respective second width along the development direction of the physical exercise surface, the second width being included between a third boundary line and a fourth boundary line, the third boundary line being at a third distance from the reference point, the fourth boundary line being at a fourth distance from the reference point, the fourth distance being greater than the third distance;

the fourth boundary line of said at least a second control zone coinciding with the first boundary line of said at least a first control zone;

b) detect the distance value of the portion of the user from the reference point;

c) compare the detected distance value with the first distance of the first boundary line of the at least a first control zone;

wherein if the detected distance value is smaller than the first distance of the first boundary line of the at least a first control zone, the electronic control unit for the movement of the physical exercise surface of the treadmill is configured to:

d1) control an increase in feeding speed of the physical exercise surface;

d2) modify the first distance of the first boundary line of the at least a first control zone from a first value to a second value, along the development direction of the physical exercise surface in a second feeding direction opposite to the first feeding direction, the second value being either greater than or equal to the detected distance value.

25. A program product which is loaded in a storage unit of an electronic computer and which is executed by a data processing unit of the electronic computer, in a current time instant $t_i$, with $1<i<N$, of a plurality of subsequent time instants $t_1, t_2, \ldots, t_N$, to perform:

a) dividing the physical exercise surface of the treadmill facing a user when training on the treadmill, into a plurality of control zones of the treadmill as a function of a distance from a reference point on the treadmill, the physical exercise surface having a development direction and a first feeding direction, the plurality of control zones, along the development direction of the physical exercise surface, comprising:

at least a first control zone having a respective first width along the development direction of the physical exercise surface, the first width being between a first boundary line and a second boundary line, the first boundary line being at a first distance from the reference point, the second boundary line being at a second distance from the reference point, the second distance being greater than the first distance, the at least a first control zone being a zone wherein the user maintains a substantially constant training speed;

at least a second control zone having a respective second width along the development direction of the physical exercise surface, the second width being included between a third boundary line and a fourth boundary line, the third boundary line being at a third distance from the reference point, the fourth boundary line being at a fourth distance from the reference point, the fourth distance being greater than the third distance;

the fourth boundary line of said at least a second control zone coinciding with the first boundary line of said at least a first control zone;

b) detecting a distance value of the portion of the user from the reference point;

c) comparing the detected distance value with the first distance of the first boundary line of the at least a first control zone;

wherein if the detected distance value is smaller than the first distance of the first boundary line of the at least a first control zone, the data processing unit of the electronic computer performs:

d1) controlling an increase in feeding speed of the physical exercise surface;

d2) modifying the first distance of the first boundary line of the at least a first control zone from a first value to a second value, along the development direction of the physical exercise surface in a second feeding direction opposite to the first feeding direction, the second value being either greater than or equal to the detected distance value.

* * * * *